US011738564B2

(12) United States Patent
Nishida et al.

(10) Patent No.: US 11,738,564 B2
(45) Date of Patent: Aug. 29, 2023

(54) INKJET PRINTER AND NON-TRANSITORY COMPUTER-READABLE STORAGE MEDIUM STORING COMPUTER-READABLE INSTRUCTIONS

(71) Applicant: BROTHER KOGYO KABUSHIKI KAISHA, Nagoya (JP)

(72) Inventors: Katsunori Nishida, Nagoya (JP); Naoki Mizuno, Takahama (JP); Shunsuke Okai, Nagoya (JP); Eiji Tanaka, Toki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/703,207

(22) Filed: Mar. 24, 2022

(65) Prior Publication Data

US 2022/0212476 A1 Jul. 7, 2022

Related U.S. Application Data

(63) Continuation of application No. PCT/JP2021/011908, filed on Mar. 23, 2021.

(30) Foreign Application Priority Data

Mar. 31, 2020 (JP) ..... 2020-065198

(51) Int. Cl.
*B41J 2/18* (2006.01)

(52) U.S. Cl.
CPC ..... *B41J 2/18* (2013.01)

(58) Field of Classification Search
CPC .... B41J 29/38; B41J 2/16552; B41J 2/17566; B41J 2/16535; B41J 2/16505;
(Continued)

(56) References Cited

U.S. PATENT DOCUMENTS 8,690,301 B2 * 4/2014 Koike ..... B41J 2/175 347/89
8,915,572 B2 12/2014 Levi et al.
(Continued)

FOREIGN PATENT DOCUMENTS

EP 2631075 A2 8/2013
JP 2006256128 A 9/2006
(Continued)

OTHER PUBLICATIONS

Written Opinion and partial English translation issued in corresponding PCT Application No. PCT/JP2021/011908, dated Jun. 1, 2021 (7 pages).

(Continued)

*Primary Examiner* — An H Do
(74) *Attorney, Agent, or Firm* — K&L Gates LLP

(57) ABSTRACT

An inkjet printer has a nozzle surface on a head and having nozzle rows each having nozzles, manifolds suppling ink to the nozzles in each nozzle row, supply flow paths connected to the manifold and suppling the ink, circulation flow paths connected to the manifold and circulating the ink from the manifold to which the ink is supplied through the supply flow path, a cap to be in contact with the nozzle surface on an outside of the nozzles respectively in two nozzle rows, and a controller executing circulation processing where circulation of the ink through one supply flow path, one manifold and one circulation flow path is performed, and circulation of the ink through another supply flow path, another manifold and another circulation flow path is not performed, in a state where the ink or a cleaning liquid supplied in the cap is contacted with the nozzle surface.

14 Claims, 11 Drawing Sheets

(58) Field of Classification Search
CPC ..... B41J 2/17509; B41J 2/175; B41J 2/1707; B41J 2/1652; B41J 29/02; B41J 2/18; B41J 2/16532; B41J 2/16523; B41J 2/16508; B41J 2002/16594; B41J 2202/12
See application file for complete search history.

(56) References Cited

U.S. PATENT DOCUMENTS

| | | | | |
|---|---|---|---|---|
| 8,926,057 | B2 * | 1/2015 | Ueno | B41J 2/16508 347/21 |
| 10,717,293 | B2 * | 7/2020 | Ishikawa | B41J 2/14233 |
| 2017/0120602 | A1 | 5/2017 | Nakai et al. | |
| 2018/0281437 | A1 | 10/2018 | Nishida et al. | |
| 2019/0193404 | A1 | 6/2019 | Nishida et al. | |
| 2019/0358961 | A1 | 11/2019 | Nishida et al. | |

FOREIGN PATENT DOCUMENTS

| | | | |
|---|---|---|---|
| JP | 2014180861 | A | 9/2014 |
| JP | 2017087708 | A | 5/2017 |
| JP | 2018171848 | A | 11/2018 |
| JP | 2019116054 | A | 7/2019 |

OTHER PUBLICATIONS

International Search Report for Application No. PCT/JP2021/011908, dated Jun. 1, 2021 (2 pages).

* cited by examiner

INKJET PRINTER AND NON-TRANSITORY COMPUTER-READABLE STORAGE MEDIUM STORING COMPUTER-READABLE INSTRUCTIONS

CROSS-REFERENCE TO RELATED APPLICATION

This is a continuation application of International Application No. PCT/JP2021/011908 filed on Mar. 23, 2021 which claims the benefit of priority from Japanese patent application No. 2020-065198 filed on Mar. 31, 2020. The entire contents of the earlier applications are incorporated herein by reference.

BACKGROUND

Known is an inkjet printer configured to circulate ink for purposes of removing air bubbles and eliminating sedimentation of ink components in a head or in a flow path from an ink storage unit to the head. For example, an inkjet printer includes a plurality of pressure generating chambers, a supply liquid chamber, a plurality of supply passages, a circulating liquid chamber, a plurality of circulation passages, and a circulation tank. The pressure generating chambers are configured to individually communicate with a plurality of nozzles and to apply a pressure to ink. The supply liquid chamber is configured to accommodate ink that is supplied to the pressure generating chambers. The supply passages are configured to supply the ink from the supply liquid chamber to the pressure generating chambers. The circulation passages are configured to communicate the pressure generating chambers and the circulating liquid chamber, and to cause the ink in the pressure generating chambers to be accommodated in the circulating liquid chamber. The ink in the circulating liquid chamber is sent to the circulation tank. Therefore, the ink is collected from the circulating liquid chamber to the circulation tank via the circulation passages, together with air bubbles. In addition, the ink circulation eliminates sedimentation of ink components.

In the inkjet printer, when a circulation speed of the ink is increased so as to further remove air bubbles and eliminate sedimentation of ink components, meniscus of the nozzles may be destroyed. In this case, the air bubbles may be drawn into the head from the nozzles. Therefore, it is considered to circulate the ink in a circulation flow path in a state where a cap is filled with the ink or a cleaning liquid. However, a positive pressure may be generated from the nozzles into the cap, in which case the cap separates from a nozzle surface. This may cause the ink to flow to an outside of the cap.

SUMMARY

An object of the present disclosure is to provide an inkjet printer and a non-transitory computer-readable storage medium storing computer-readable instructions, which enable to reduce a positive pressure that is generated in a cap and reducing a possibility that ink will flow to an outside of the cap.

A first aspect of the present disclosure is an inkjet printer including a nozzle surface, a plurality of manifolds, supply flow paths, circulation flow paths, a cap and a controller. The nozzle surface is provided on a head and has a plurality of nozzle rows each having a plurality of nozzles. The plurality of manifolds are configured to supply ink to the nozzles provided in each nozzle row. The supply flow paths are connected to at least one of the manifolds and are configured to supply the ink to the manifold connected to the supply flow paths. The circulation flow paths are connected to at least one of the manifolds and are configured to circulate the ink from the manifold to which the ink is supplied through the supply flow path. The cap is provided to be in contact with the nozzle surface on an outside of the nozzles respectively provided in at least two of the nozzle rows. The controller is configured to execute first circulation processing where head circulation of circulating the ink through one of the supply flow paths, one of the manifolds and one of the circulation flow paths is performed, and head circulation of circulating the ink through another of the supply flow paths, another of the manifolds and another of the circulation flow paths is not performed, in a liquid-contact state where the ink or a cleaning liquid supplied in the cap is contacted with the nozzle surface.

A second aspect of the present disclosure is a non-transitory computer-readable medium storing computer-readable instructions, when executed by a computer of an inkjet printer. The inkjet printer includes a nozzle surface, a plurality of manifolds, supply flow paths, circulation flow paths, a cap and the computer. The nozzle surface is provided on a head configured to eject ink and has a plurality of nozzle rows each having a plurality of nozzles configured to eject the ink. The plurality of manifolds are configured to supply the ink to the nozzles provided in each nozzle row. The supply flow paths are connected to at least one of the manifolds and are configured to supply the ink to the manifold connected to the supply flow paths. The circulation flow paths are connected to at least one of the manifolds and are configured to circulate the ink from the manifold to which the ink is supplied through the supply flow path. The cap is provided to be in contact with the nozzle surface on an outside of the nozzles respectively provided in at least two of the nozzle rows. The computer-readable instructions cause the computer to perform first circulation processing where head circulation of circulating the ink through one of the supply flow paths, one of the manifolds and one of the circulation flow paths is performed, and head circulation of circulating the ink through another of the supply flow paths, another of the manifolds and another of the circulation flow paths is not performed, in a liquid-contact state where the ink or a cleaning liquid supplied in the cap is contacted with the nozzle surface.

Due to the first circulation processing where the head circulation through one of the supply flow paths, one of the manifolds and one of the circulation flow paths is performed and the head circulation through another of the supply flow paths, another of the manifolds and another of the circulation flow paths is not performed, a positive pressure that is generated in the cap can be reduced, as compared to a case where the head circulation of circulating the ink through the one of the supply flow paths, the one of the manifolds and the one of the circulation flow paths is performed and the head circulation of circulating the ink through the another of the supply flow paths, the another of the manifolds and another of the circulation flow paths is also performed. Therefore, it is possible to reduce a possibility that the cap will separate from the nozzle surface and the ink will flow to an outside of the cap.

DETAILED DESCRIPTION

A schematic configuration of a printer 1 will be described with reference to FIGS. 1 and 2. The upper, lower, left lower, right upper, right lower and left upper in FIG. 1 are the upper, lower, front, rear, right and left of the printer 1, respectively.

Figure 1:
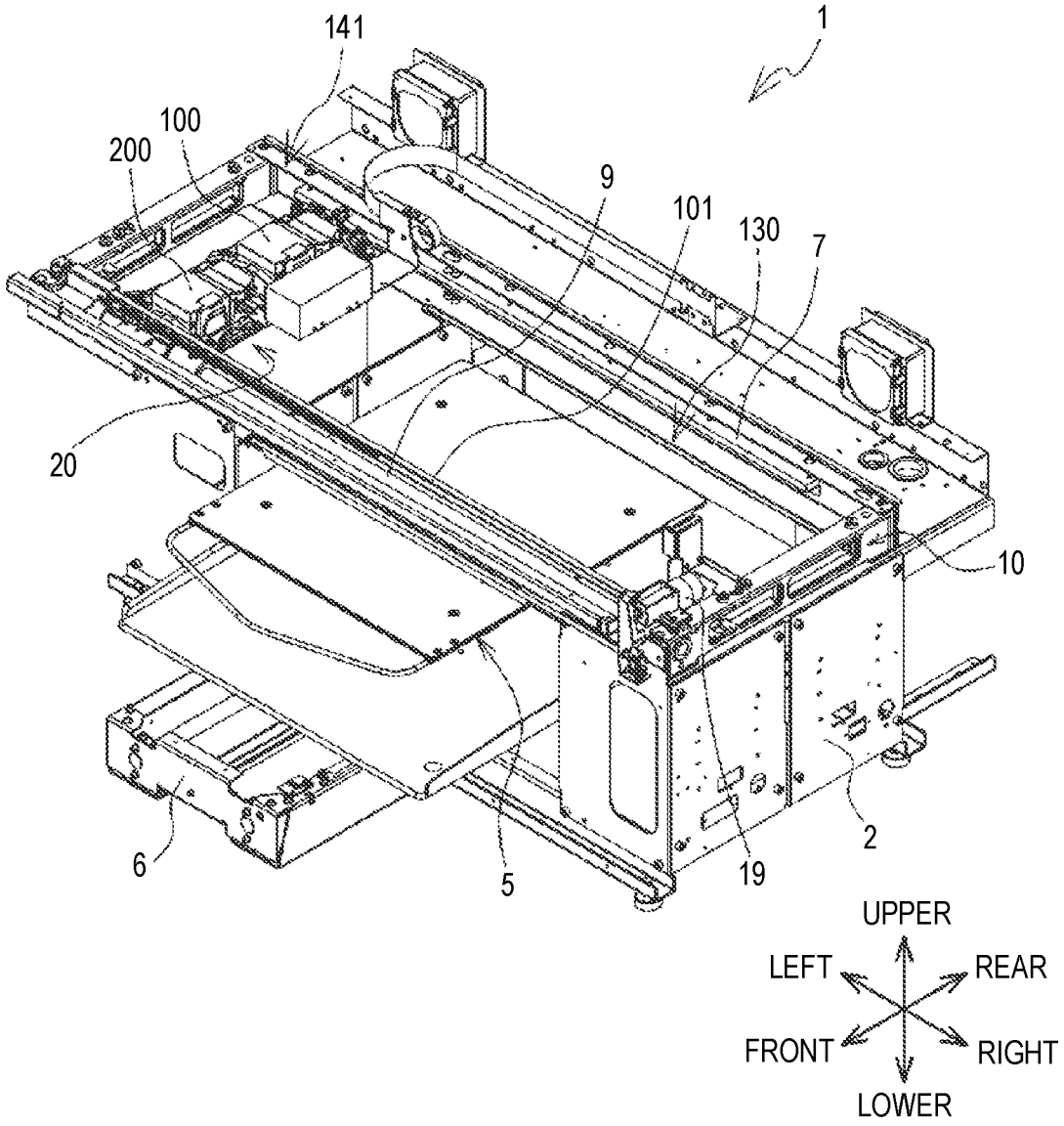
FIG. 1 is a perspective view of an internal structure of a printer 1.

As shown in FIG. 1, the printer 1 is configured to perform printing by ejecting ink onto a printing medium (not shown) such as a paper and cloth such as a T-shirt. In the present embodiment, the printer 1 is configured to print a color image on the printing medium by ejecting downward five types of inks (white (W), black (K), yellow (Y), cyan (C), and magenta (M)) different from each other. In descriptions below, white ink of the five types of inks is referred to as white ink, and inks of four colors of black, cyan, yellow and magenta are referred to as color ink when they are collectively referred to. Further, when collectively referring to white ink and color ink or when any one is not specified, they are simply referred to as ink. By including a resin component in the ink, the adhesion of the ink to the printing medium is improved. The white ink also contains an emulsion and contains titanium oxide as a pigment. Titanium oxide has a relatively high specific gravity, and pigment particles tend to precipitate. Therefore, when printing of the white ink is not performed for a long time, it is preferable to perform the printing by the white ink after eliminating the precipitation of the white ink.

As shown in FIG. 1, the printer 1 includes a housing 2, a frame body 10, a guide shaft 9, a rail 7, a carriage 20, head units 100 and 200, a drive belt 101, a drive motor 19, a platen drive mechanism 6, a platen 5, and the like. The housing 2 is provided with an operation unit (not shown). The operation unit includes a display 45 (refer to FIG. 8) and an operation button 46 (refer to FIG. 8). The operation button 46 is operated when an operator inputs instructions concerning various operations of the printer 1.

The frame body 10 has a substantially rectangular frame shape, in plan view, and is installed on an upper part of the housing 2. The frame body 10 is configured to support the guide shaft 9 on a front side and the rail 7 on a rear side, respectively. The guide shaft 9 extends in a right and left direction inside the frame body 10. The rail 7 is arranged to face the guide shaft 9 extending in the right and left direction. The carriage 20 is supported to be conveyable in the right and left direction along the guide shaft 9. As shown in FIG. 1, the head units 100 and 200 are arranged in a front and rear direction and mounted on the carriage 20. The head unit 100 is located behind the head unit 200.

The drive belt 101 is bridged along the right and left direction inside the frame body 10. The drive motor 19 is provided on a right front part inside the frame body 10. The drive motor 19 is connected to the carriage 20 via the drive belt 101. When the drive motor 19 drives the drive belt 101, the carriage 20 reciprocally moves in the right and left direction (scanning direction). This causes the head units 100 and 200 to reciprocally move in the right and left direction.

The platen drive mechanism 6 includes a pair of guide rails (not shown) and the platen 5. The pair of guide rails extends in the front and rear direction inside the platen drive mechanism 6 and is configured to support the platen 5 so as to be movable in the front and rear direction. The platen 5 has a plate shape and is provided below the frame body 10. The platen 5 is configured to hold the printing medium at the top. The platen drive mechanism 6 is configured to be driven by a sub-scanning drive unit 16 (refer to FIG. 8), which will be described later, thereby moving the platen 5 in the front and rear direction along the pair of guide rails. Printing is performed on the printing medium by ejecting the ink from a head part 110 configured to reciprocally move in the right and left direction while the platen 5 conveys the printing medium in the front and rear direction (sub-scanning direction).

Figure 2:
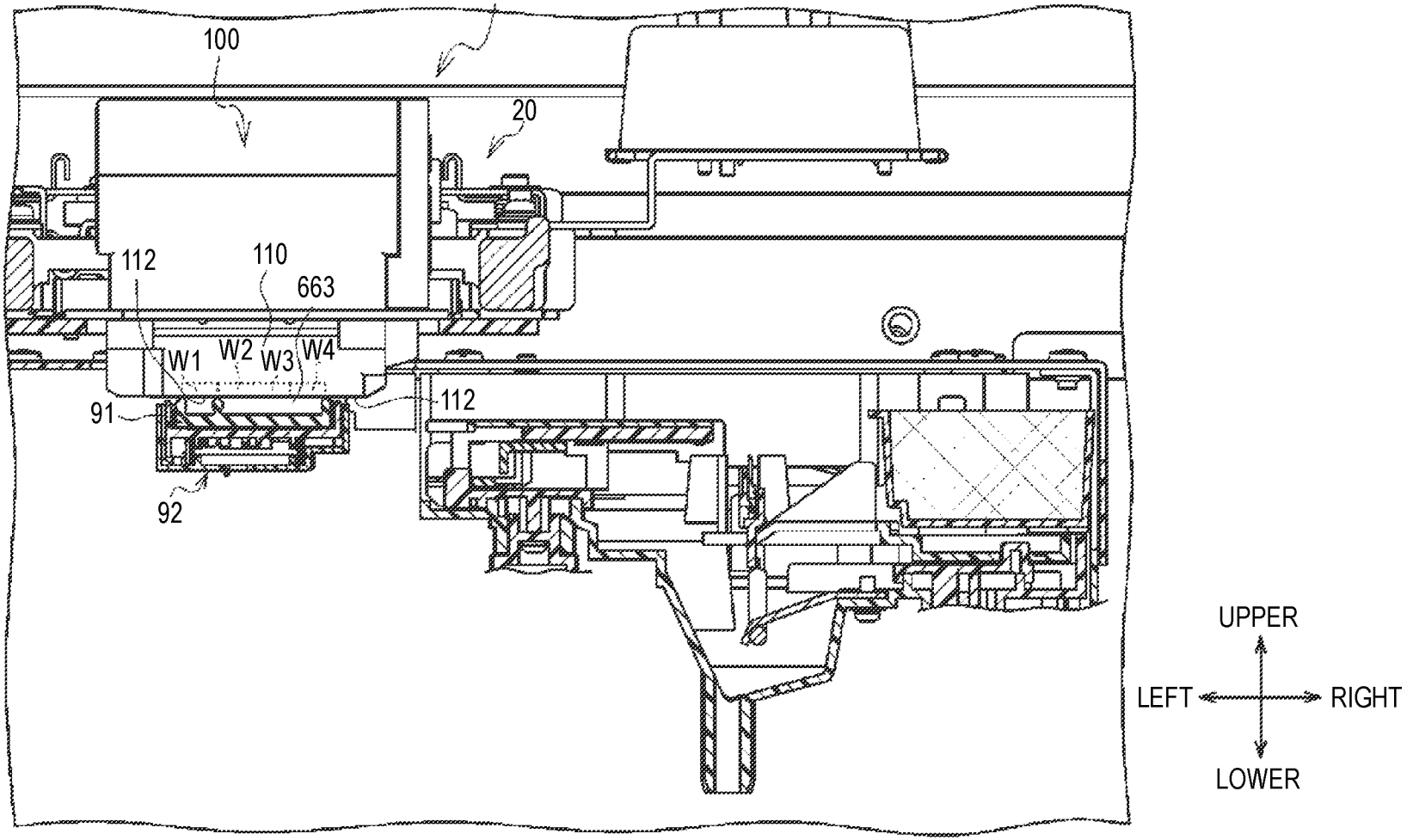
FIG. 2 is a longitudinal sectional view of the internal structure of the printer 1.

As shown in FIG. 2, a maintenance unit 141 of the printer 1 includes a cap 91 and a cap support part 92. The cap 91 is supported by the cap support part 92, and is provided to be in contact with a nozzle surface 112, which will be described later, on an outside of a first nozzle row W1, a second nozzle row W2, a third nozzle row W3, and a fourth nozzle row W4 (which will be described later) by a cap drive unit 18 (refer to FIG. 8).

<Head Unit 100>

Figure 3:
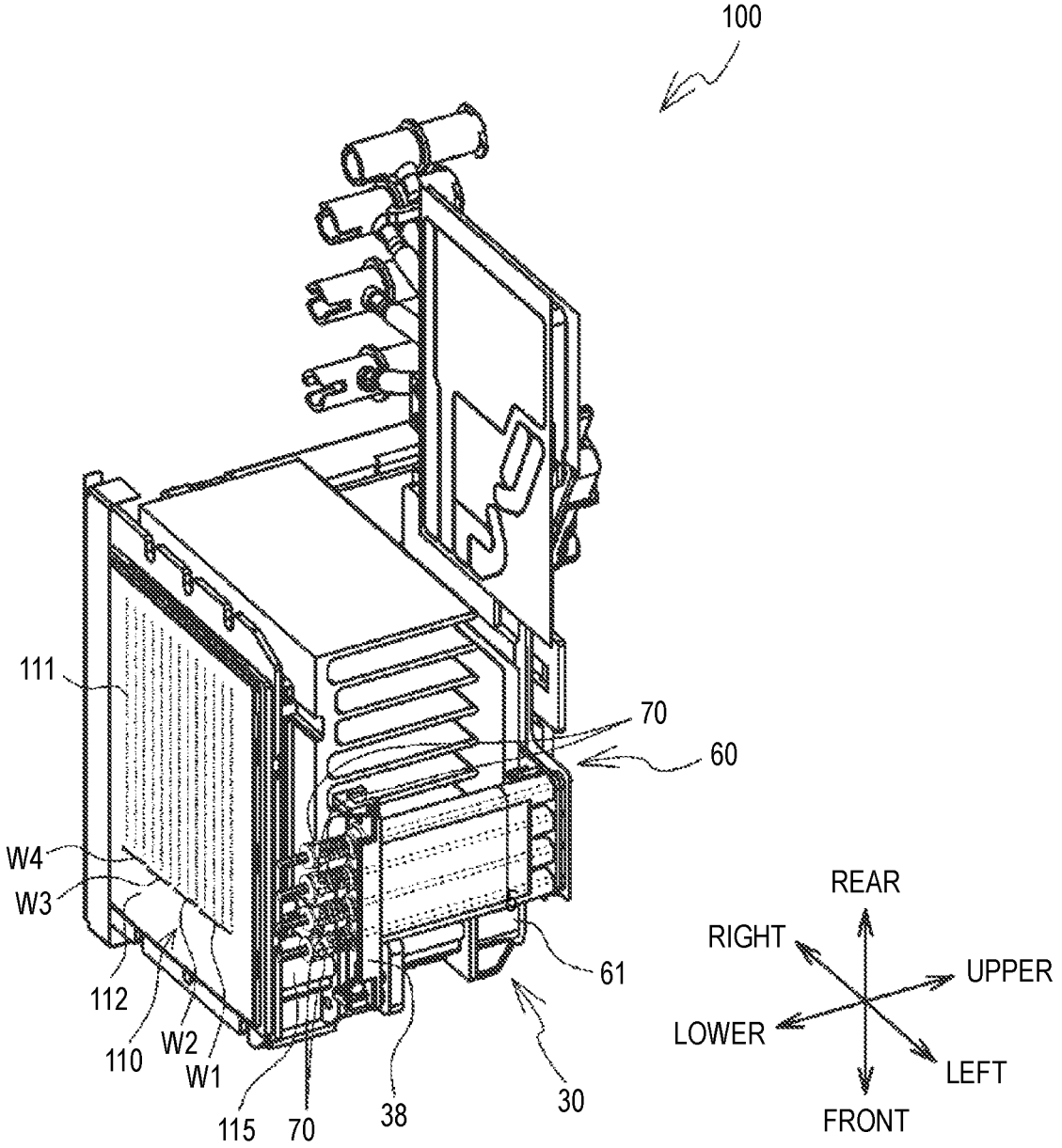
FIG. 3 is a perspective view of a head unit 100.

A detailed configuration of the head unit 100 will be described with reference to FIGS. 3 and 4. As shown in FIG. 3, the head unit 100 includes a housing 30, a head part 110, a buffer tank 60, and the like. The housing 30 has a substantial box shape and is configured to support the head part 110 configured to eject ink at a lower part. An inside of the head part 110 is divided into, for example, four ink chambers (not shown) configured to supply white ink to manifolds 170A, 180A, 170B and 180B. The head part 110 has a planar nozzle surface 112. The nozzle surface 112 is provided with a plurality of nozzles 111 for ejecting white ink. The plurality of nozzles 111 is aligned in a row rearward from the front side of the nozzle surface 112 along the front and rear direction, and is aligned in a plurality of rows along the right and left direction. As shown in FIG. 3, the plurality of nozzles 111 is divided into four sets of a first nozzle row W1, a second nozzle row W2, a third nozzle row W3, and a fourth nozzle row W4 from the left. The plurality of nozzles 111 corresponds to a plurality of ejection channels (not shown) provided in the head part 110. A plurality of piezoelectric elements (not shown) provided in the head part 110 is driven, so that the plurality of ejection channels can eject downward white ink from the plurality of nozzles 111 corresponding to the plurality of ejection channels. The head unit 100 is placed on the carriage 20 with the nozzle surface 112 facing downward.

Figure 4:
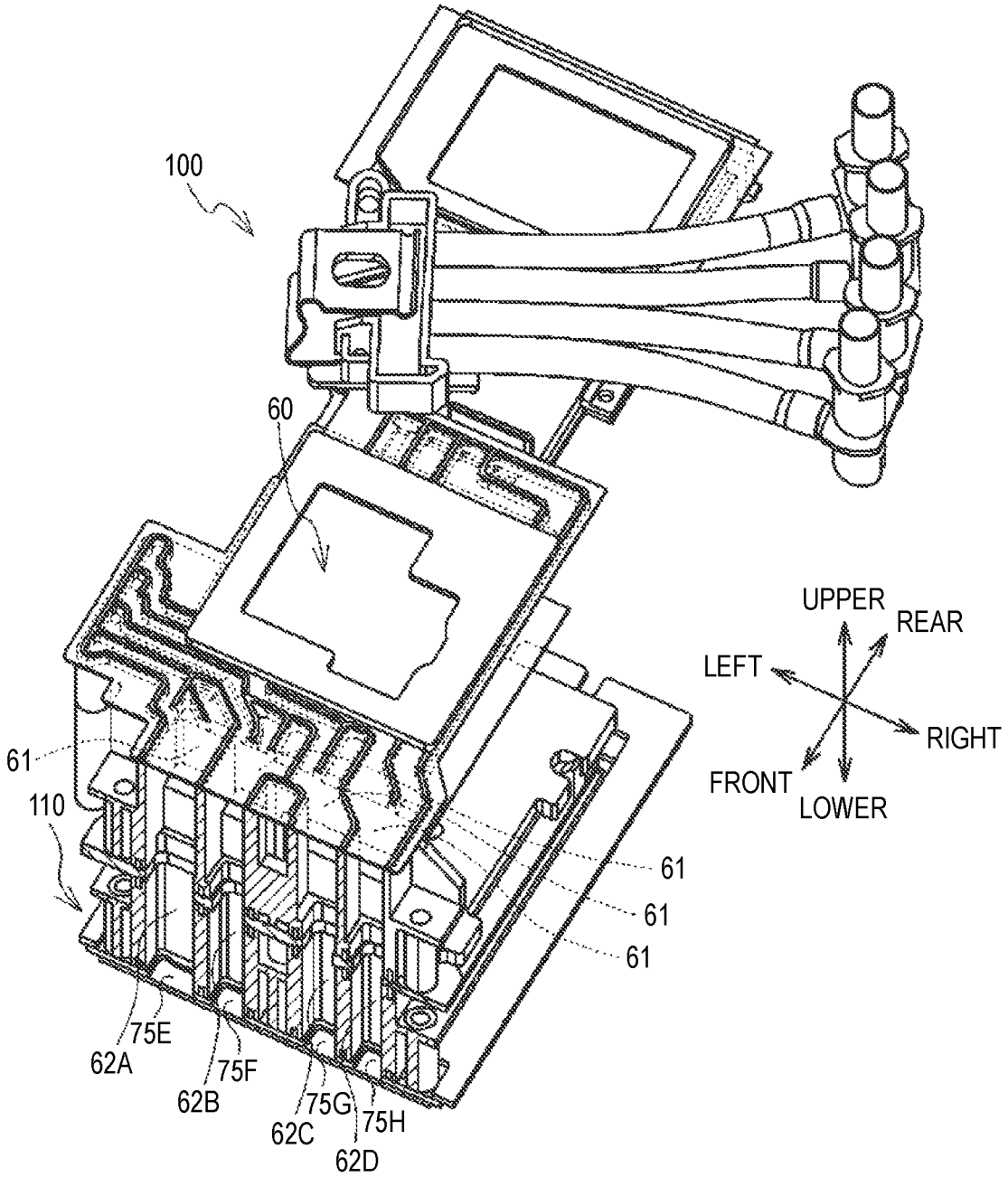
FIG. 4 is a partially cross-sectional area of the head unit 100.

As shown in FIGS. 3 and 4, the buffer tank 60 has a hollow cuboid shape and is formed to extend in parallel to the nozzle surface 112 at an upper part of the head unit 100. The buffer tank 60 is configured to temporarily store ink therein to absorb a pressure fluctuation of the ink supplied to the head part 110, and then to supply the ink to the head part 110. As shown in FIG. 4, the buffer tank 60 includes four storage chambers 61 configured to store ink on the front side, and each storage chamber 61 is connected to each of flow paths 62A, 62B, 62C and 62D facing downward. The flow paths 62A, 62B, 62C and 62D have filters 75E, 75F, 75G and 75H provided at a lower part, respectively. The flow paths 62A to 62D are respectively connected to the manifolds 170A, 180A, 170B and 180B, which will be described later, via the filters 75E to 75H, respectively.

<Structures of Manifolds of First Nozzle Row W1 and Second Nozzle Row W2>

Figure 5:
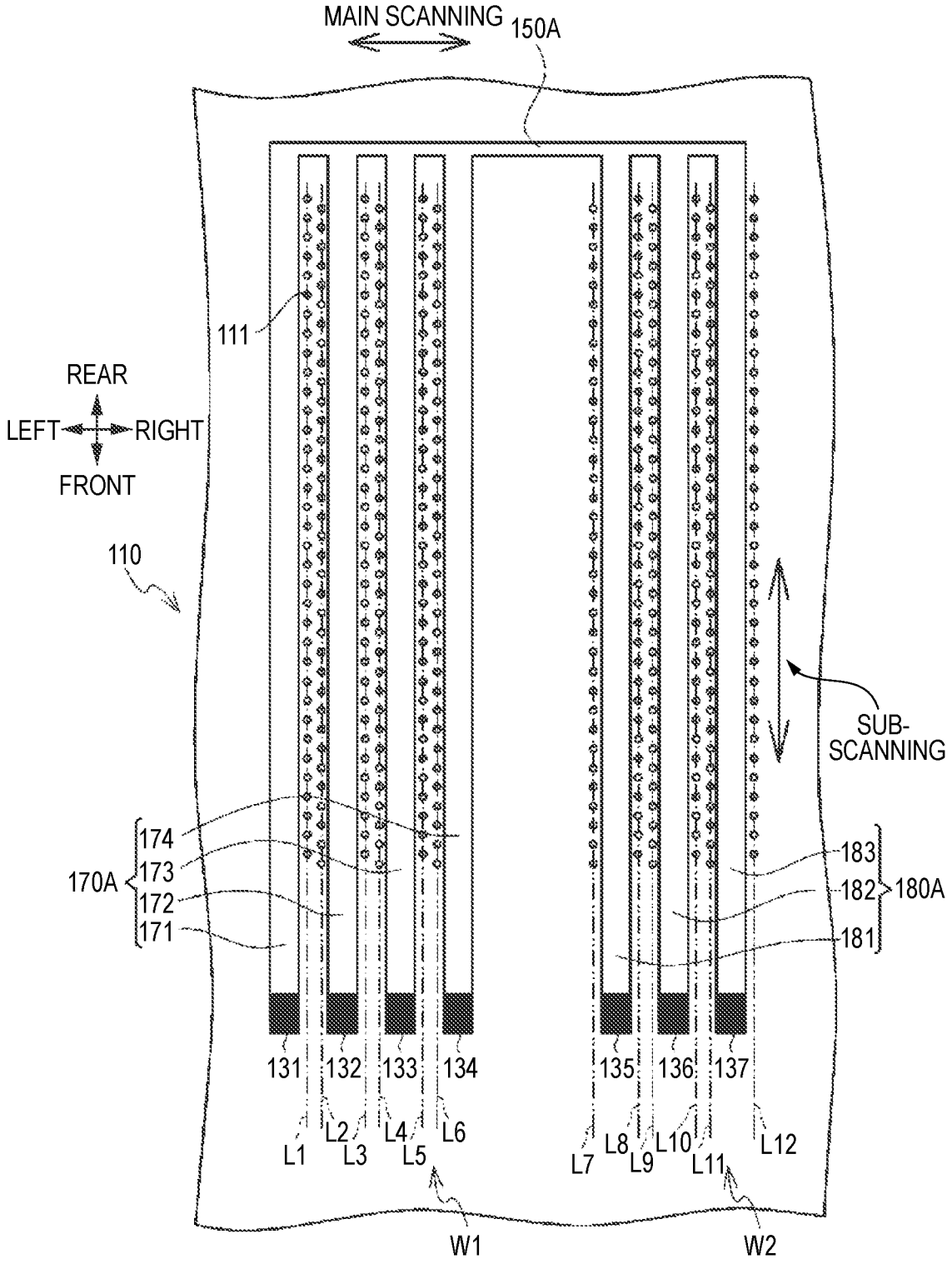
FIG. 5 is a partially cross-sectional view showing nozzles 111 and manifolds 170A and 180A of a head part 110.

Structures of manifolds of the first nozzle row W1 and the second nozzle row W2 are described with reference to FIG. 5. FIG. 5 is a partial cross-sectional view showing structures of manifolds in the head part 110 shown in FIG. 4. In FIG. 5, structures of manifolds of the first nozzle row W1 and the second nozzle row W2 are shown, and the third nozzle row W3 and the fourth nozzle row W4 on the right side of the second nozzle row W2 are omitted. As shown in FIG. 5, the head part 110 has the first nozzle row W1 and the second nozzle row W2. The first nozzle row W1 has a plurality of manifolds 171 to 174 and a plurality of nozzle rows L1 to L6. The second nozzle row W2 has a plurality of manifolds 181 to 183 and a plurality of nozzle rows L7 to L12. The manifold 171 of the first nozzle row W1 is configured to communicate with the nozzles 111 included in the nozzle row L1. The manifold 172 is configured to communicate with the nozzles 111 included in the nozzle rows L2 and L3. The manifold 173 is configured to communicate with the nozzles 111 included in the nozzle rows L4 and L5. The manifold 174 is configured to communicate with the nozzles 111 included in the nozzle rows L6. Respective front end portions of the manifolds 171 to 174 are provided with supply ports 131, 132, 133 and 134, respectively. The supply ports 131 to 134 are connected to the flow path 62A via the filter 75E (refer to FIG. 4), and therefore, can supply the ink 68 to the manifolds 171 to 174, respectively. Hereinafter, the manifolds 171 to 174 are also referred to as 'manifold 170A'.

In addition, the manifold 181 of the second nozzle row W2 is configured to communicate with the nozzles 111 included in the nozzle rows L7 and L8. The manifold 182 is configured to communicate with the nozzles 111 included in the nozzle rows L9 and L10. The manifold 183 is configured to communicate with the nozzles 111 included in the nozzle rows L11 and L12. Respective front end portions of the manifolds 181 to 183 are provided with supply ports 135, 136 and 137, respectively. The supply ports 135 to 137 are connected to the flow path 62B via the filter 75F (refer to FIG. 4), and therefore, can supply the ink 68 to the manifolds 181 to 183, respectively. Hereinafter, the manifolds 181 to 183 are also referred to as 'manifold 180A'. Respective rear end portions of the manifolds 181 to 183 are connected to a left end-side of a communication passage 150A. In addition, respective rear end portions of the manifolds 171 to 174 are connected to a right end-side of the communication passage 150A.

When performing printing on a printing medium, the ink 68 is supplied from the supply ports 131 to 137 to the manifolds 171 to 174 and 181 to 183, respectively, and is ejected from the nozzle rows L1 to L12, as described above. In addition, during head circulation of the ink 68, which will be described later, the ink 68 flows from one side to the other side of the first nozzle row W1 and the second nozzle row W2. For example, the ink 68 flows from the supply ports 131 to 134 to the manifolds 171 to 174, respectively, and the ink 68 flows to the manifolds 181 to 183 via the communication passage 150A and returns to the supply ports 135 to 137. Therefore, during the head circulation of the ink 68, the manifolds 171 to 174, the communication passage 150A, and the manifolds 181 to 183 form a circulation flow path of the ink 68 in the head part 110. The flow paths 62A to 62D, the manifolds 171 to 174 and 181 to 183 and the communication passage 150A in the head part 110 are narrower and more complicated in structure than flow paths 714C, 715C and 802 (refer to FIG. 6) outside the head part 110, which will be described later. Therefore, a flow path resistance inside the head part 110 is greater than a flow path resistance outside the head part 110. Note that, the structure is similar to the flow path for supplying the ink 68 to the third nozzle row W3 and the fourth nozzle row W4.

<Ink Supply Units 700A and 700B>

Figure 6:
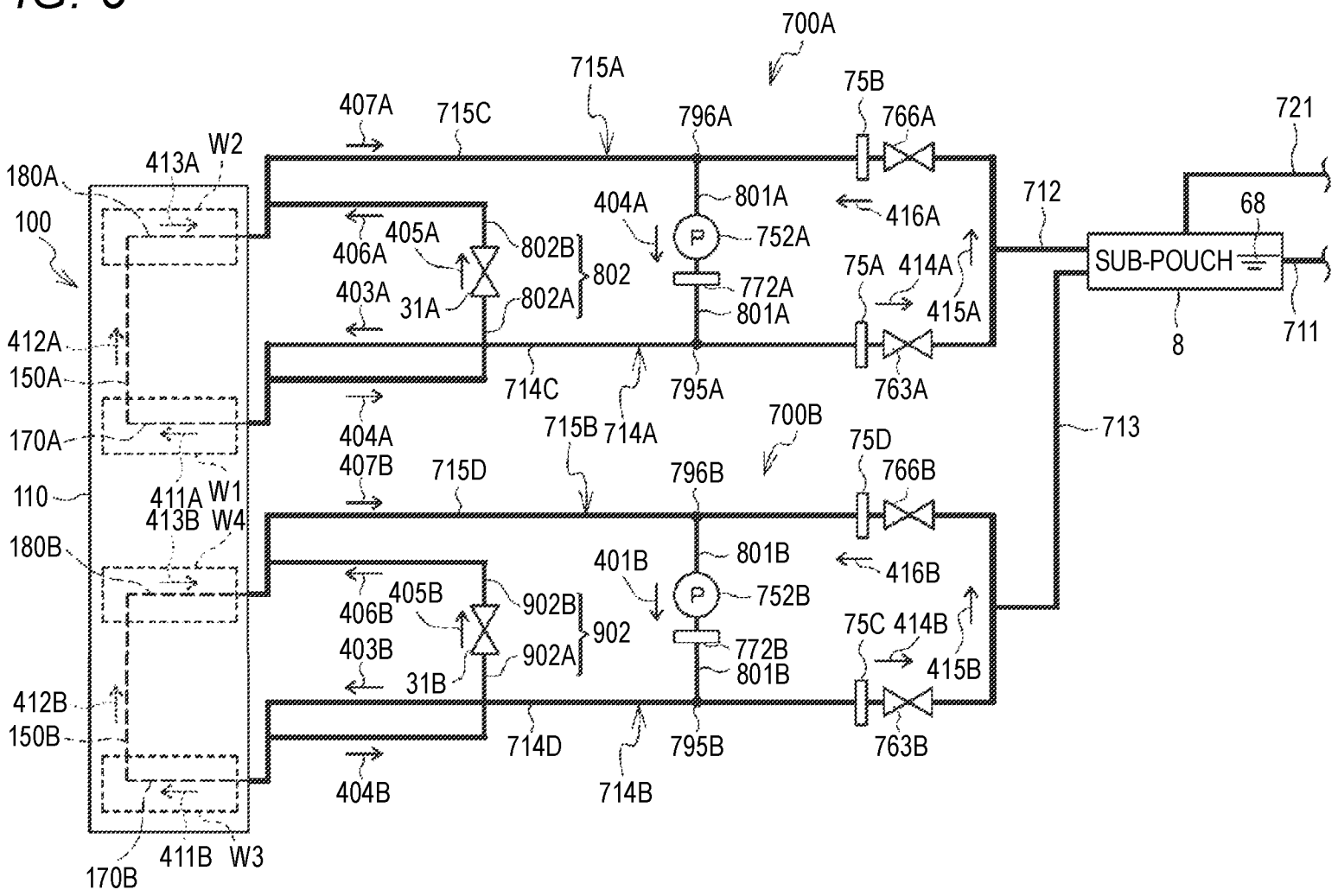
FIG. 6 shows a flow path configuration of ink 68 of the printer 1.

As shown in FIG. 6, ink supply units 700A and 700B are parts where the ink 68 is supplied from a sub-pouch 8 to the head part 110 and the ink 68 circulates. As an example, the sub-pouch 8 has a flexible bag shape and is configured to accommodate the ink 68 supplied from a main tank (not shown) of white ink. In addition, the sub-pouch 8 is connected to the main tank (not shown) of white ink by a first flow path 711. The ink 68 in the sub-pouch 8 is circulated to the main tank by a circulation flow path 721. The sub-pouch 8 is connected to the ink supply unit 700A via a second flow path 712, and is connected to the ink supply unit 700B via a third flow path 713.

The ink supply unit 700A includes a fourth flow path 714A, a fifth flow path 715A, a first bypass flow path 801A, a second bypass flow path 802A, a second bypass flow path 802B, a pump 752A, and electromagnetic valves 31A, 763A and 766A, and filters 75A, 75B and 772A. Hereinafter, the second bypass flow path 802A and the second bypass flow path 802B are collectively referred to as 'second bypass flow path 802' unless there is need to make a distinction. As shown in FIG. 6, one end of the manifold 170A of the head part 110 is connected to the flow path 62A shown in FIG. 4, and the other end is connected to the communication passage 150A. One end of the manifold 180A is connected to the flow path 62B shown in FIG. 4, and the other end is connected to the communication passage 150A. Since a flow path of the fourth flow path 714A(714C), which is in the head part 110, is the flow path 62A, the fourth flow path 714A(714C) is connected to the manifold 170A and supplies the ink 68 to the manifold 170A. Since a flow path of the fifth flow path 715A(715C), which is in the head part 110, is the flow path 62B, the fifth flow path 715A(715C) is connected to the manifold 180A and supplies the ink 68 to the manifold 180A. A relationship between the manifolds 170B and 180B and the fourth flow path 714B and fifth flow path 715B is similar to a relationship between the manifolds 170A and 180A and the fourth flow path 714A and fifth flow path 715A.

As shown in FIG. 6, the second flow path 712 is connected to the sub-pouch 8, the fourth flow path 714A and the fifth flow path 715A, and is configured to supply the ink 68 from the sub-pouch 8 to the fourth flow path 714A and the fifth flow path 715A. The third flow path 713 is connected to the sub-pouch 8, the fourth flow path 714B and the fifth flow path 715B, and is configured to supply the ink 68 from the sub-pouch 8 to the fourth flow path 714B and the fifth flow path 715B. The fourth flow path 714A has the electromagnetic valve 763A and the filter 75A. The electromagnetic valve 763A is configured to be controlled by a CPU 11 (refer to FIG. 8), thereby opening and closing the fourth flow path 714A. The fifth flow path 715B has the electromagnetic valve 766A and the filter 75B. The electromagnetic valve 766A is configured to be controlled by the CPU 11, thereby opening and closing the fifth flow path 715A.

The first bypass flow path 801A is configured to connect the fourth flow path 714A and the fifth flow path 715A each other outside the head part 110. For example, the first bypass flow path 801A is configured to connect the fourth flow path 714A and the fifth flow path 715A each other downstream of the filters 75A and 75B. The bypass flow path 801A has the filter 772A and the pump 752A. The filter 772A is provided on the fourth flow path 714A-side with respect to the pump 752A. Note that, a side, which is downstream of a connection place with the first bypass flow path 801A, of the fourth flow path 714A is referred to as a fourth flow path 714C. In addition, a side, which is downstream of the connection place with the first bypass flow path 801A, of the fifth flow path 715A is referred to as a fifth flow path 715C. The fifth flow path 715C functions as a circulation flow path of the ink 68 during circulation processing of ink, which will be described later.

On the head part 110-side with respect to the first bypass flow path 801A, the fourth flow path 714A and the fifth flow path 715A are connected via the second bypass flow path 802. The second bypass flow path 802 has the electromagnetic valve 31A. The electromagnetic valve 31A is configured to be controlled by the CPU 11, thereby opening and closing the second bypass flow path 802. A flow path, which is between the electromagnetic valve 31A and the fourth flow path 714C, of the second bypass flow path 802 is referred to as 'second bypass flow path 802A', and a flow path, which is between the electromagnetic valve 31A and the fifth flow path 715C, of the second bypass flow path 802 is referred to as 'second bypass flow path 802B'.

The ink supply unit 700B has a configuration similar to the ink supply unit 700A, and includes a fourth flow path 714B, a fifth flow path 715B, a first bypass flow path 801B, a second bypass flow path 902A, a second bypass flow path 902B, a pump 752B, and electromagnetic valves 31B, 763B and 766B, and filters 75C, 75D and 772B. Hereinafter, the second bypass flow path 902A and the second bypass flow path 902B are collectively referred to as 'second bypass flow path 902' unless there is need to make a distinction. The head part 110 further includes a third nozzle row W3 and a fourth nozzle row W4 for ejecting white ink, a communication passage 150B, a manifold 170B and a manifold 180B. One end of the manifold 170B is connected to the flow path 62C, and the other end is connected to the communication passage 150B. One end of the manifold 180B is connected to the flow path 62D, and the other end is connected to the communication passage 150B.

The fourth flow path 714B is connected to the third flow path 713 and the manifold 170B, and is configured to supply the ink 68 to the manifold 170B. The manifold 170B is configured to supply the ink 68 to the nozzles 111 (refer to FIG. 3) of the third nozzle row W3. The fifth flow path 715B is connected to the third flow path 713 and the manifold 180B, and is configured to supply the ink 68 to the manifold 180B. The manifold 180B is configured to supply the ink 68 to the nozzles 111 (refer to FIG. 4) of the fourth nozzle row W4.

The fourth flow path 714B has the electromagnetic valve 763B and the filter 75C. The electromagnetic valve 763B is configured to be controlled by the CPU 11, thereby opening and closing the fourth flow path 714B. The fifth flow path 715B has the electromagnetic valve 766B and the filter 75D. The electromagnetic valve 766B is configured to be controlled by the CPU 11, thereby opening and closing the fifth flow path 715B.

The first bypass flow path 801B is configured to connect the fourth flow path 714B and the fifth flow path 715B each other. For example, the first bypass flow path 801B is configured to connect the fourth flow path 714B and the fifth flow path 715B each other, downstream of the filters 75C and 75D. The bypass flow path 801B has the filter 772B and the pump 752B. The filter 772B is provided on the fourth flow path 714B-side with respect to the pump 752B. Note that, a side, which is downstream of a connection place with the first bypass flow path 801B, of the fourth flow path 714B is referred to as a fourth flow path 714D. In addition, a side, which is downstream of the connection place with the first bypass flow path 801B, of the fifth flow path 715B is referred to as a fifth flow path 715D. The fifth flow path 715D functions as a circulation flow path of the ink 68 during circulation processing of ink, which will be described later.

In addition, on the head part 110-side, the fourth flow path 714B and the fifth flow path 715B are connected via the second bypass flow path 902. The second bypass flow path 902 has the electromagnetic valve 31B. The electromagnetic valve 31 is configured to be controlled by the CPU 11, thereby opening and closing the second bypass flow path 902. A flow path, which is between the electromagnetic valve 31B and the fourth flow path 714D, of the second bypass flow path 902 is referred to as 'second bypass flow path 902A', and a flow path, which is between the electromagnetic valve 31B and the fifth flow path 715D, of the second bypass flow path 902 is referred to as 'second bypass flow path 902B'. Note that, although the flow paths 62A to 62D and the filters 75E to 75H shown in FIG. 4 are not shown in FIG. 6, the positions where they are provided are parts of the fourth flow paths 714A and 714B and the fifth flow paths 715A and 715B connected to the manifolds 170A, 180A, 170B and 180B, in the head part 110.

<Cleaning Liquid Supply Unit 120>

Figure 7:
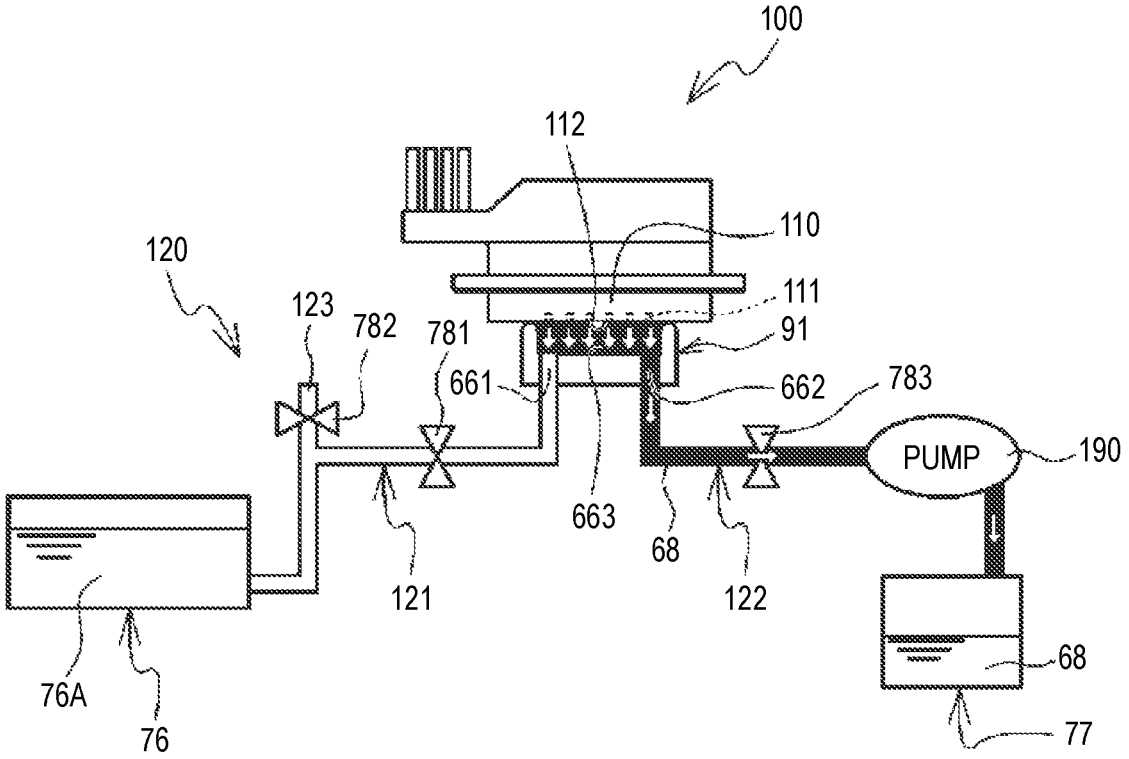
FIG. 7 is a flow path diagram of a cleaning liquid 76A and the ink 68.

A cleaning liquid supply unit 120 shown in FIG. 7 is provided in the printer 1, and includes a cleaning liquid bottle 76, a cleaning liquid flow path 121, a drainage flow path 122, a suction pump 190, and a drainage tank 77. The cleaning liquid bottle 76 is configured to accommodate the cleaning liquid 76A. The cleaning liquid flow path 121 is configured to connect the cleaning liquid bottle 76 and a supply hole 661 of the cap 91 and to supply the cleaning liquid 76A to an inside 663 of the cap 91. In addition, the cleaning liquid flow path 121 has an atmospheric opening port 123, an electromagnetic valve 781, and an electromagnetic valve 782. The electromagnetic valve 782 is configured to open and close the atmosphere opening port 123. The electromagnetic valve 781 is configured to open and close the cleaning liquid flow path 121. The drainage flow path 122 is configured to connect an exhaust hole 662 of the cap 91 and the drainage tank 77. In addition, the drainage flow path 122 has an electromagnetic valve 783 and the suction pump 190. The electromagnetic valve 783 is configured to open and close the drainage flow path 122. The suction pump 190 is configured to suck the air, ink 68 and cleaning liquid 76A in the drainage flow path 122 and the cap 91 and to discharge the same to the drainage tank 77.

<Electrical Configuration of Printer 1>

Figure 8:
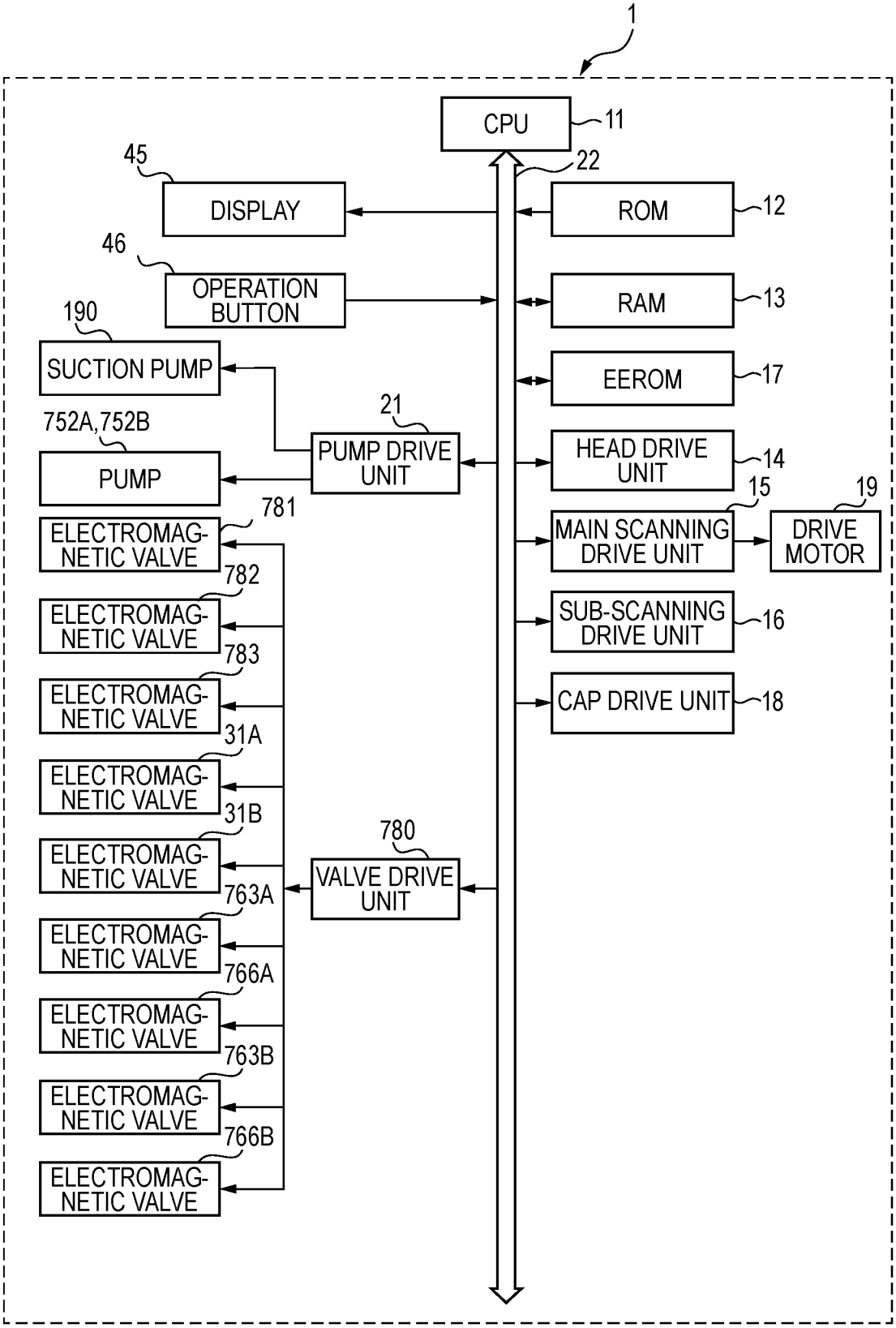
FIG. 8 is a block diagram showing an electrical configuration of the printer 1.

As shown in FIG. 8, the printer 1 includes the CPU 11 responsible for control of the printer 1. The CPU 11 is electrically connected to a ROM 12, a RAM 13, a head drive unit 14, a main scanning drive unit 15, a sub-scanning drive unit 16, an EEPROM 17, a cap drive unit 18, a display 45, an operation button 46, a pump drive unit 21 and a valve drive unit 780 via a bus 22.

The ROM 12 is configured to store a control program, initial values, and the like for the CPU 11 to control an operation of the printer 1. The RAM 82 is configured to temporarily store a variety of data that are used for the control program. The EEPROM 17 is a non-volatile memory, and is configured to store a time at which printing processing (S1), which will be described later, ends, and the like. The head drive unit 83A is electrically connected to the head part 110 configured to eject ink, and is configured to drive a piezoelectric element provided in each ejection channel of the head part 110 (refer to FIGS. 3 and 4) to eject ink from the nozzles 111.

The main scanning drive unit 15 is connected to the drive motor 19 and is configured to move the carriage 20 in the right and left direction (main scanning direction). The sub-scanning drive unit 16 includes a motor, a gear, and the like (not shown), and is configured to drive the platen drive mechanism 6 (refer to FIG. 1) to move the platen 5 in the front and rear direction (sub-scanning direction).

The cap drive unit 18 includes a cap drive motor (not shown), a gear, and the like, and is configured to move the cap support part 92 shown in FIG. 2 in the upper and lower direction to move the cap 91 in the upper and lower direction. The display 45 is configured to display a variety of information. An input from the operation button 46 is input to the CPU 11. The pump drive unit 21 is configured to drive and control the suction pump 190, the pump 752A and the pump 752B. The valve drive unit 780 is configured to drive and control the electromagnetic valves 781, 782, 783, 784, 31A, 31B, 763A, 766A, 763B and 766B.

<Liquid-Contact Circulation Processing>

Liquid-contact circulation processing is described with reference to FIGS. 6 to 11. In the printer 1, circulation of the ink 68 is performed at regular intervals for purposes of removing air bubbles in the ink 68 and eliminating sedimentation of ink components such as pigment in the flow path of the ink 68. In this case, in order to further remove air bubbles and eliminate sedimentation of ink components, when a circulation speed of the ink 68 is increased and circulation of the ink 68 is performed, a meniscus of the nozzle 111 may be destroyed. When the meniscus is destroyed, a malfunction such as introduction of air bubbles into the head part 110 from the nozzle 111 or outflow of the ink 68 from the nozzle 111 may occur. Therefore, it is considered to perform liquid-contact circulation so as to increase the circulation speed of the ink 68 and to perform circulation of the ink 68 while reducing the possibility of occurrence of the malfunction. In the liquid-contact circulation, the ink 68 is circulated, for example, in the first bypass flow path 801A, the fourth flow path 714C, the manifold 170A, the communication passage 150A, the manifold 180A and the fifth flow path 715C, in a state where the cap 91 is closely contacted with the nozzle surface 112 so as to cover the nozzles 111 and the cap 91 is filled with the cleaning liquid 76A. When a positive pressure is generated from the nozzles 111 into the cap 91, the cap 91 may separate from the nozzle surface 112, and the ink 68 may flow to an outside of the cap 91. In this case, the ink 68 may adhere to a component of the printer 1. For example, when the ink adheres to the cap support part 92 and a spring (not shown) for pressing the cap 91, the pigment and resin components of the ink 68 remain on the cap support part 92 and the spring, resulting in poor capping of the cap 91 to the nozzle surface 112. Further, if the ink 68 leaking from the cap 91 adheres to a sensor (not shown), a detection failure may be caused. In addition to this, if the leaked ink 68 adheres to other driving components, a driving failure may be caused. The liquid-contact circulation processing of the present embodiment aims to reduce the positive pressure that is generated in the cap 91.

For example, when a power supply of the printer 1 becomes on, the CPU 11 reads out a program of main processing (not shown) for performing main control such as a printing operation of the printer 1, a program of liquid-contact circulation processing (refer to FIG. 9), and the like from the ROM 12, and develops the programs onto the RAM 13. The CPU 11 executes the main processing and the liquid-contact circulation processing according to the programs.

Figure 9:
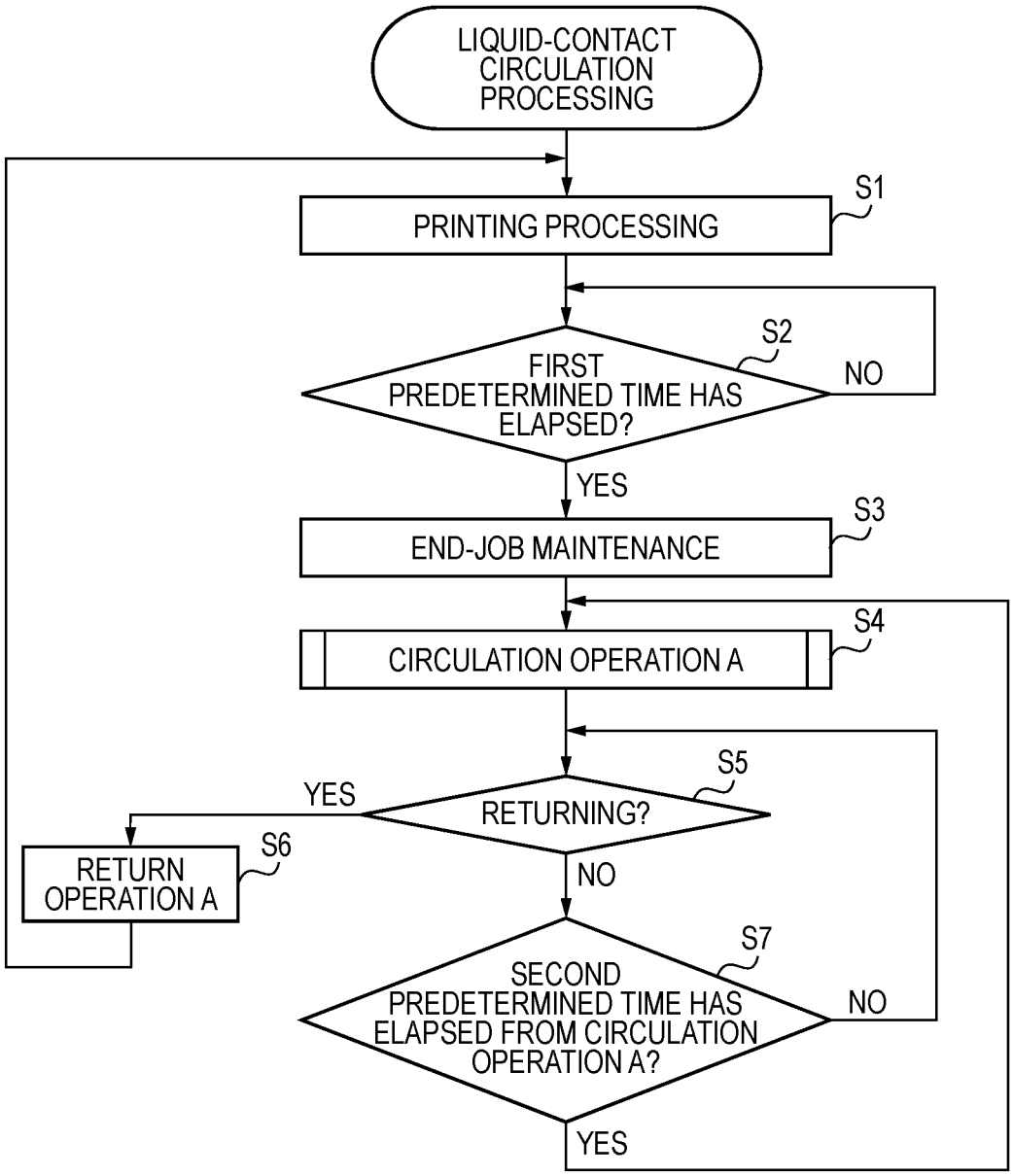
FIG. 9 is a flowchart of liquid-contact circulation processing.
Figure 10:
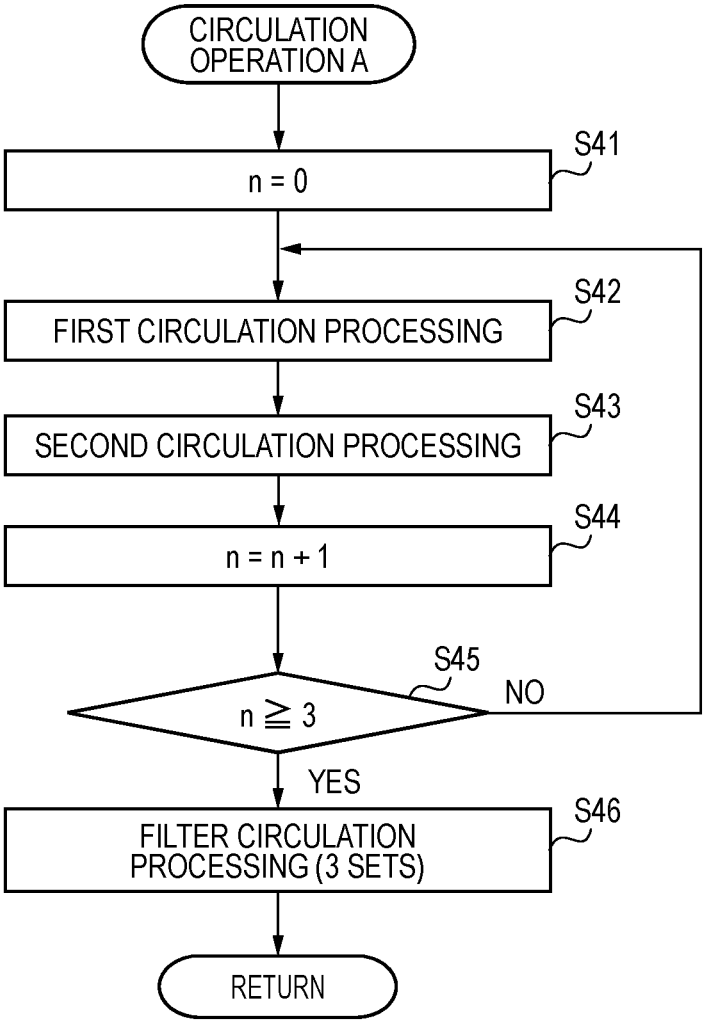
FIG. 10 is a sub-routine of a circulation operation A.

As shown in FIG. 9, when printing processing (S1) ends, the CPU 11 raises the cap 91 by the cap drive unit 18 and brings the cap 91 in contact with the nozzle surface 112 of the head part 110 so as to prevent the nozzles 111 from drying. Then, the CPU 11 stores an end time in the EEPROM 17 (S1). Next, the CPU 11 determines whether a first predetermined time has elapsed from the end time of the latest printing processing (S1) stored in the EEPROM 17 (S2). The first predetermined time is, for example, 6 hours. When it is not determined that the first predetermined time has elapsed (S2: NO), the CPU 11 continues the determination of S2. When it is determined that the first predetermined time has elapsed (S2: YES), the CPU 11 performs end-job maintenance.

Figure 11:
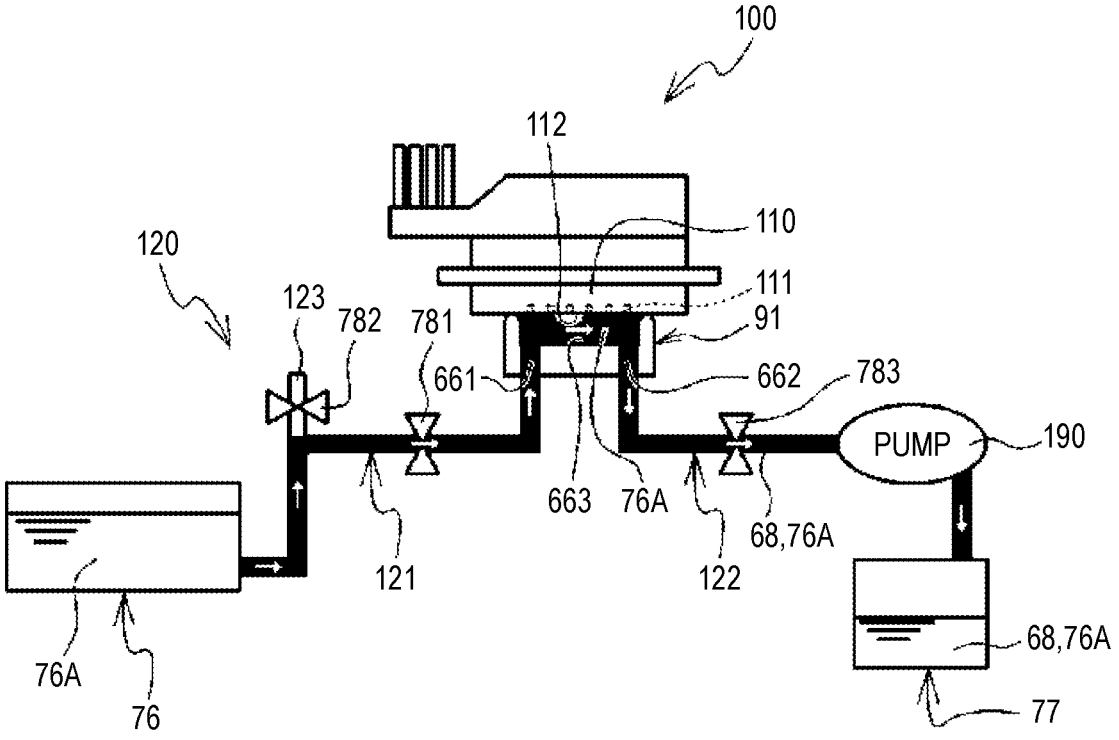
FIG. 11 is a flow path diagram showing a liquid-contact state.

An example of the end-job maintenance is described with reference to FIGS. 7 and 11. The CPU 11 closes the electromagnetic valve 781 and opens the electromagnetic valve 783 in a state where the cap 91 is in contact with the nozzle surface 112 of the head part 110. Next, the CPU 11 drives the suction pump 190 for a certain time. The insides of the drainage flow path 122 and the cap 91 become a negative pressure, and the CPU 11 executes a purge in which ink is sucked from the nozzles 111 of the head part 110, as shown in FIG. 7. Next, the CPU 11 opens the electromagnetic valve 781 and closes the electromagnetic valve 782. The electromagnetic valve 783 remains open. Next, the CPU 11 drives the suction pump 190. The insides of the drainage flow path 122, the cap 91, and the cleaning liquid flow path 121 become a negative pressure, and as shown in FIG. 11, the cleaning liquid 76A flows from the cleaning liquid bottle 76 to the cleaning liquid flow path 121, the electromagnetic valve 781, and the cap 91. Thereafter, the CPU 11 stops the suction pump 190 and closes the electromagnetic valve 781 and the electromagnetic valve 783. Therefore, the inside of the cap 91 is filled with the cleaning liquid, and the state in which the cleaning liquid 76A is in contact with the nozzle surface 112 is maintained.

<Circulation Operation A>

Next, the CPU 11 executes a circulation operation A (S4). As the circulation operation A, in first circulation processing, the CPU 11 performs head circulation, which will be described later, for the first nozzle row W1 and the second nozzle row W2, and does not perform the head circulation for the third nozzle row W3 and the fourth nozzle row W4. Since the filter 772A is provided on a downstream side with respect to a direction in which the pump 752A delivers the ink 68, a zero point of a pressure at which the positive pressure due to the delivery of the ink 68 from the pump 752A and the negative pressure due to the suction of the ink 68 of the pump 752A are balanced is moved to the manifold 170A-side of the first nozzle row W1 with respect to a center of the communication passage 150A. As a result, a negative pressure is generated in the nozzles 111 of the first nozzle row W1 and the second nozzle row W2. However, actually, a suction capability of the pump 752A to suck the ink 68 cannot create an absolute vacuum due to the structure of the pump 752A, and is specified to a predetermined value. In contrast, a delivery capability of the pump 752A to deliver the ink 68 can be made higher than the suction capability by increasing a number of rotations of the pump 752A. Therefore, in the head circulation, when the number of rotations of the pump 752A is increased, the flow path resistances of the manifold 170A, the communication passage 150A, and the manifold 180A of the head part 110 are large, so that the suction capability of the pump 752A cannot catch up with the delivery capability, the zero point of the pressure is moved to the manifold 180A-side and the positive pressure may be thus generated in the nozzles 111 of the first nozzle row W1 and the second nozzle row W2.

In head-outside circulation such as bypass circulation and filter circulation (which will be described later) in which the ink 68 does not circulate in the head part 110 having a large flow path resistance but circulates in a flow path outside the head part 110, the flow path resistance of the flow path through which the ink 68 passes is much smaller, as compared to the head circulation. Therefore, a load that is applied to the pump 752B is reduced, and the suction capability of the pump 752B is not reduced. Further, in the head-outside circulation, the ink 68 can be circulated through the second bypass flow paths 802 and 902, the fourth flow path 714A, and the fifth flow path 715A, which are further apart from the nozzles 111, as compared to the head circulation. Therefore, the zero point of the pressure is on the manifold 170A-side, and a negative pressure is applied to the nozzles 111. That is, in the head-outside circulation, the positive pressure that is applied to the nozzles 111 is reduced, as compared to the head circulation. The same applies to the third nozzle row W3-side and the fourth nozzle row W4-side. In the present embodiment, the CPU 11 reduces the positive pressure, which is generated in the cap 91, by executing, in the ink supply units 700A and 700B, the head circulation on one side and executing the head-outside circulation or not executing circulation on the other side, without executing the head circulation at the same time. Hereinafter, the circulation operation A is described with reference to a sub-routine shown in FIG. 10. First, the CPU 11 resets a counter n configured to count numbers of execution times of first circulation processing (S42) and second circulation processing (S43), as 'n=0' (S41).

<First Circulation Processing>

Next, the CPU 11 executes first circulation processing (S42). As the first circulation processing, the CPU 11 performs head circulation, which will be described later, for the first nozzle row W1 and the second nozzle row W2 for a predetermined time. In addition, as the first circulation processing, the CPU 11 performs bypass circulation, which will be described later, for the third nozzle row W3 and the fourth nozzle row W4 for a predetermined time.

<Head Circulation of First Nozzle Row W1 and Second Nozzle Row W2 In First Circulation Processing>

The head circulation of the first nozzle row W1 and the second nozzle row W2 in the first circulation processing is described with reference to FIG. 6. The CPU 11 closes the electromagnetic valve 763A, the electromagnetic valve 766A, and the electromagnetic valve 31A of the ink supply unit 700A. Next, the CPU 11 drives the pump 752A at a predetermined rotation speed for a predetermined time. Therefore, the ink 68 flows from the pump 752A through the first bypass flow path 801A in a direction of an arrow 401A and through the fourth flow path 714C in a direction of an arrow 403A. Since the electromagnetic valve 31A is closed, the ink 68 flows through the manifold 170A, the communication passage 150A, and the manifold 180A of the head part 110 in directions of arrows 411A, 412A and 413A. Next, the ink 68 flows through the fifth flow path 715C in a direction of an arrow 407A and flows into the first bypass flow path 801A. The ink 68 flowing into the first bypass flow path 801A flows from the pump 752A in the direction of the arrow 401A and circulates in a similar manner to described above. The CPU 11 stops the pump 752A after performing the head circulation of the ink 68 for a predetermined time.

<Circulation Other Than Head Circulation of Third Nozzle Row W3 and Fourth Nozzle Row W4 In First Circulation Processing>

Circulation other than the head circulation of the third nozzle row W3 and the fourth nozzle row W4 is described with reference to FIG. 6. An example of the circulation other than the head circulation is the head-outside circulation. The circulation other than the head circulation of the third nozzle row W3 and the fourth nozzle row W4 is circulation in which the ink 68 does not circulate through the fourth flow path 714D, the manifold 170B, the communication passage 150B, the manifold 180B, and the fifth flow path 715D. For example, the CPU 11 closes the electromagnetic valves 763B and 766B of the ink supply unit 700B and opens the electromagnetic valves 31B. Next, the CPU 11 drives the pump 752B at a predetermined number of rotations for a predetermined time. The ink 68 flows from the pump 752B through the first bypass flow path 801A in a direction of an arrow 401B and through the fourth flow path 714D in a direction of an arrow 403B. As described above, the flow path resistances of the manifold 170B, the communication passage 150B and the manifold 180B are greater than those of the second bypass flow paths 902A and 902B. Therefore, the ink 68 flows through the second bypass flow path 902A in a direction of an arrow 404B. Next, the ink 68 flows through the electromagnetic valve 31B in a direction of an arrow 405B, through the second bypass flow path 902B in a direction of an arrow 406B and through the fifth flow path 715D in a direction of an arrow 407B, and flows into the first bypass flow path 801B. The ink 68 flowing into the first bypass flow path 801B flows from the pump 752B in the direction of the arrow 401B and circulates in a similar manner to described above. This circulation is called bypass circulation. The CPU 11 stops the pump 752B after performing the bypass circulation of the ink 68 for a predetermined time. In the first circulation processing, the CPU 11 simultaneously executes, for example, the head circulation and the bypass circulation. For example, the CPU 11 may start the rotation of the pump 752A in the head circulation and the rotation of the pump 752B in the bypass circulation at the same time, rotate the pumps at the same rotation speed for a predetermined time, and end the rotations at the same time. In addition, the CPU 11 may make the rotation speed of the pump 752A slower than the rotation speed of the pump 752B, and make the circulation speed of the ink 68 in the head circulation slower than the circulation speed of the ink 68 in the bypass circulation. Further, the CPU 11 may cause the pump 752A to perform intermittent driving that repeats drive for a predetermined time and stop for a predetermined time. Further, the CPU 11 may start the head circulation later than the bypass circulation by driving the pump 752A for performing the head circulation after driving the pump 752B for performing the bypass circulation. Further, the CPU 11 may end the head circulation earlier than the circulation other than the head circulation, such as the bypass circulation, by stopping the drive of the pump 752A for performing the head circulation earlier than stopping the drive of the pump 752B for performing the bypass circulation.

<Second Circulation Processing>

Next, the CPU 11 executes second circulation processing (S43). As the second circulation processing, the CPU 11 performs the bypass circulation as an example of the circulation other than the head circulation for the first nozzle row W1 and the second nozzle row W2 for a predetermined time, and performs the head circulation for the third nozzle row W3 and the fourth nozzle row W4 for a predetermined time.

<Bypass Circulation of Ink Supply Unit 700A in Second Circulation Processing>

The circulation other than the head circulation of the first nozzle row W1 and the second nozzle row W2 is circulation where the ink 68 does not circulate through the fourth flow path 714C, the manifold 170A, the communication passage 150A, the manifold 180A, and the fifth flow path 715C, and is, for example, the above-described bypass circulation. The CPU 11 executes bypass circulation in the ink supply unit 700A. Since the bypass circulation in the ink supply unit 700A is similar to the bypass circulation in the ink supply unit 700B described above, the description thereof is omitted.

<Head Circulation of Third Nozzle Row W3 and Fourth Nozzle Row W4 In Second Circulation Processing>

The head circulation of the third nozzle row W3 and the fourth nozzle row W4 in the second circulation processing is described. The CPU 11 executes head circulation in the ink supply unit 700B. Since the head circulation in the ink supply unit 700B is similar to the head circulation in the ink supply unit 700A described above, the description thereof is omitted.

Next, the CPU 11 sets the counter n=n+1 (S44). Therefore, n=1. The CPU 11 determines whether n≥3 (S45), and when the CPU 11 does not determine n≥3 (S45: NO), the CPU advances the processing to S42, and repeats the processing of S42 to S45 in a similar manner to described above. When three sets of the first circulation processing and the second circulation processing are executed, n=3, and therefore, the CPU 11 determines n≥3 (S45: YES). Next, the CPU 11 performs three sets of filter circulation processing in the ink supply units 700A and 700B (S46).

<Filter Circulation>

The filter circulation in the ink supply unit 700A is described with reference to FIG. 6. The CPU 11 opens the electromagnetic valve 763A and the electromagnetic valve 766A and closes the electromagnetic valve 31A of the ink supply unit 700A. Next, the CPU drives the pump 752A for a predetermined time. The ink 68 flows from the pump 752A through the first bypass flow path 801A in the direction of the arrow 401A. The flow path resistances of the manifold 170A, the communication passage 150A and the manifold 180A are greater than those of the fourth flow path 714A and the fifth flow path 715A. Therefore, the ink 68 flows through the fourth flow path 714A in a direction of an arrow 414A, rather than in the direction of the manifold 170A, the communication passage 150A and the manifold 180A. Therefore, the ink 68 flows through the filter 75A and the electromagnetic valve 763A in the direction of the arrow 414A, flows through the fifth flow path 715A in a direction of an arrow 416A, flows through the electromagnetic valve 766A and the filter 75B, and flows into the first bypass flow path 801A. The ink 68 flowing into the first bypass flow path 801A flows from the pump 752A in the direction of the arrow 401A and circulates in a similar manner to described above. The CPU 11 stops the pump 752B after performing the filter circulation of the ink 68 for a predetermined time. Since the filter circulation in the ink supply unit 700B is similar to the filter circulation in the ink supply unit 700A, the description thereof is omitted.

After executing three sets of the above-described filter circulation, the CPU 11 returns the processing to the liquid-contact circulation processing of FIG. 9, and determines whether the processing is returned from the liquid-contact state (S5). The CPU 11 determines as returning, when a printing instruction is input from the operation button 46 (refer to FIG. 8) or when a printing instruction is input from a terminal apparatus (not shown) such as a computer connected to the printer 1 (S5: YES). When the CPU 11 determines as returning (S5: YES), the CPU 11 performs a return operation A as follows (S6). As shown in FIG. 11, the CPU 11 opens the electromagnetic valves 781, 782 and 783 in a state where the cap 91 is in contact with the nozzle surface 112 of the head part 110. Next, the CPU 11 drives the suction pump 190 for a certain time to discharge the cleaning liquid 76A of the cap 91 to the drainage tank 77. Next, as shown in FIG. 7, the CPU 11 closes the electromagnetic valve 781, opens the electromagnetic valve 783, and drives the suction pump 190 for a certain time to perform the above-described purge processing. Next, the CPU 11 controls the cap drive unit 18 (refer to FIG. 8) to separate the cap 91 from the nozzle surface 112. Next, the CPU performs a nozzle surface wiping operation of wiping off excess ink and the like remaining on the surface of the nozzle surface 112 of the head part 110 by a wiper 36 (refer to FIG. 2). Next, the CPU 11 executes printing processing (S1). Thereafter, the CPU performs the processing of S2 to S5, as described above.

When the CPU 11 does not determine as returning (S5: NO), the CPU determines whether a second predetermined time has elapsed from the circulation operation A (S7). An example of the second predetermined time is 6 hours. When YES is not determined in the determination of S6, the CPU 11 advances the processing to S5. When YES is determined in the determination of S6, the CPU 11 advances the processing to S4 and performs the circulation operation A. Thereafter, the CPU performs the determinations of S5 to S7, in a similar manner to described above.

<Operational Effects of Embodiment>

As described above, in the liquid-contact state where the cleaning liquid 76A supplied in the cap 91 is contacted with the nozzle surface 112, the CPU 11 of the printer 1 executes the first circulation processing (S42) where the head circulation of circulating the ink 68 through the fourth flow path 714C, the manifold 170A, the communication path 150A, the manifold 180A and the fifth flow path 715C is performed on the ink supply unit 700A-side and the head circulation of circulating the ink 68 through the fourth flow path 714C, the manifold 170A, the communication passage 150A, the manifold 180A and the fifth flow path 715C is not performed on the ink supply unit 700B-side. Therefore, as compared to a case where the head circulation is performed on the ink supply unit 700A-side and the head circulation is performed on the ink supply unit 700B-side, the head circulation where a positive pressure is generated in the nozzles 111 is not performed at the same time, so that the positive pressure that is generated in the cap can be reduced. Therefore, a possibility that the cap 91 will separate from the nozzle surface 112 and the ink 68 will flow to an outside of the cap can be reduced. If the ink 68 flows to the outside of the cap, the content and resin included in the ink 68 remain on the spring (not shown) for moving the cap 91 and the cap support part 92, resulting in poor capping of the cap 91 to the nozzle surface 112. Further, if the ink 68 adheres to a sensor (not shown), a detection failure of the sensor occurs, and if the ink 68 adheres to other drive components, a drive failure occurs. In the present embodiment, since the possibility that the cap 91 will separate from the nozzle surface 112 and the ink 68 will flow to the outside of the cap is reduced, the above-described problems can be solved.

In addition, in the liquid-contact state where the cleaning liquid 76A supplied in the cap 91 is contacted with the nozzle surface 112, the CPU 11 executes the second circulation processing (S43) where the head circulation of circulating the ink 68 through the fourth flow path 714D, the manifold 170B, the communication path 150B, the manifold 180B and the fifth flow path 715D is performed on the ink supply unit 700B-side and the head circulation of circulating the ink 68 through the fourth flow path 714C, the manifold 170A, the communication passage 150A, the manifold 180A and the fifth flow path 715C is not performed on the ink supply unit 700A-side. Therefore, as compared to a case where the head circulation is performed on the ink supply unit 700A-side and the head circulation is performed on the ink supply unit 700B-side, the head circulation where the positive pressure is generated is not performed at the same time, so that removal of air bubbles and elimination of sedimentation of ink components can be made even in the fourth flow path 714D, the manifold 170B, the communication passage 150B, the manifold 180B and the fifth flow path 715D while reducing the positive pressure that is generated in the cap 91.

Further, the CPU 11 executes the first circulation processing (S42) of performing the bypass circulation of circulating the ink 68 in the fourth flow path 714D, the second bypass flow path 902, the fifth flow path 715D and the first bypass flow path 801A. Therefore, in the bypass circulation, the ink 68 is circulated through the second bypass flow path 902, which is further apart from the nozzles 111 than the manifolds 170B and 180B. As described above, a negative pressure is generated in the nozzles 111 in the bypass circulation. Therefore, the positive pressure that is generated in the cap 91 can be reduced by performing the bypass circulation together with the head circulation, as the first circulation processing (S42). Further, in the bypass circulation, since the flow path resistance of the flow path through which the ink 68 passes is smaller than the case of the head circulation, the ink circulates more through the flow path, and the sedimentation of components of the ink 68 can be eliminated.

Further, the CPU 11 executes the second circulation processing (S43) of performing the bypass circulation of circulating the ink 68 in the fourth flow path 714C, the second bypass flow path 802 and the fifth flow path 715C. Therefore, in the bypass circulation, the ink 68 is circulated through the second bypass flow path 802 whose flow path resistance is smaller than those of the manifolds 170A and 180A. Therefore, as the second circulation processing (S43), by performing the bypass circulation through the fourth flow path 714C, the second bypass flow path 802 and the fifth flow path 715C, together with the head circulation through the fourth flow path 714D, the manifold 170B, the communication passage 150B and the manifold 180B, the possibility that the positive pressure will be generated in the cap can be reduced.

The nozzle surface 112 of the printer 1 has the nozzles 111 provided as the first nozzle row W1, the second nozzle row W2, the third nozzle row W3, and the fourth nozzle row W4. In addition, the printer 1 has the manifold 170A configured to supply the ink 68 to the nozzles 111 provided in the first nozzle row W1, the manifold 180A configured to supply the ink 68 to the nozzles 111 provided in the second nozzle row W2, the manifold 170B configured to supply the ink 68 to the nozzles 111 provided in the third nozzle row W3 and the manifold 180B configured to supply the ink 68 to the nozzles 111 provided in the fourth nozzle row W4. Further, the printer 1 has the fourth flow path 714C connected to one of the manifold 170A and the manifold 180A and configured to supply the ink 68, and the fourth flow path 714D connected to one of the manifold 170B and the manifold 180B and configured to supply the ink 68. Further, the printer 1 has the fifth flow path 715C connected to one of the manifold 170A and the manifold 180A and configured to circulate the ink 68, and the fifth flow path 715D connected to one of the manifold 170B and the manifold 180B and configured to circulate the ink 68. The cap 91 is provided to be in contact with the nozzle surface 112 on an outside of the nozzles 111 respectively provided in the first nozzle row W1, the second nozzle row W2, the third nozzle row W3, and the fourth nozzle row W4. The CPU 11 executes the first circulation processing (S42) where the head circulation of circulating the ink 68 is performed in the fourth flow path 714C, the manifold 170A, the manifold 180A and the fifth flow path 715C and the head circulation of circulating the ink 68 is not performed in the fourth flow path 714D, the manifold 170B, the manifold 180B and the fifth flow path 715C, in the liquid-contact state.

Therefore, in the liquid-contact state, by the first circulation processing (S42) where the head circulation of circulating the ink 68 is performed in the fourth flow path 714C, the manifold 170A, the manifold 180A and the fifth flow path 715C and the head circulation of circulating the ink 68 is not performed in the fourth flow path 714D, the manifold 170B, the manifold 180B and the fifth flow path 715C, the positive pressure that is generated in the cap 91 can be reduced. Therefore, the possibility that the cap 91 will separate from the nozzle surface 112 and the ink 68 will flow to an outside of the cap can be reduced.

The CPU 11 executes the second circulation processing (S43) where the head circulation of circulating the ink 68 is performed in the fourth flow path 714D, the manifold 170B, the manifold 180B and the fifth flow path 715D and the head circulation of circulating the ink 68 is not performed in the fourth flow path 714C, the manifold 170A, the manifold 180A and the fifth flow path 715C, in the liquid-contact state. Therefore, while reducing the positive pressure that is generated in the cap 91, the removal of air bubbles and the elimination of sedimentation of ink components are improved even in the fourth flow path 714D, the manifold 170B, the manifold 180B and the fifth flow path 715D.

The printer 1 includes the second bypass flow path 902 configured to connect the fourth flow path 714D and the fifth flow path 715D, and the CPU 11 executes the first circulation processing (S42) where the bypass circulation of circulating the ink 68 is performed in the second bypass flow path 902, which connects the fourth flow path 714D and the fifth flow path 715D. Therefore, the positive pressure that is generated in the cap 91 can be reduced by performing the bypass circulation together with the head circulation, as the first circulation processing (S42). In addition, the printer 1 includes the second bypass flow path 802 configured to connect the fourth flow path 714C and the fifth flow path 715C, and the CPU 11 executes the second circulation processing (S43) where the bypass circulation of circulating the ink 68 is performed in the fourth flow path 714C, the fifth flow path 715C and the second bypass flow path 802. Therefore, the positive pressure that is generated in the cap 91 can be reduced by performing the bypass circulation together with the head circulation, as the second circulation processing (S43).

In the first circulation processing (S42) or the second circulation processing (S43), the CPU 11 may cause the rotation speed of the pump 752A and the rotation speed of the pump 752B to differ from each other, thereby causing the circulation speed of the ink 68 in the head circulation and the circulation speed of the ink 68 in the circulation such as the bypass circulation other than the head circulation to differ from each other. For example, in the first circulation processing (S42), the CPU 11 makes the rotation speed of the pump 752A slower than the rotation speed of the pump 752B, and in the second circulation processing (S43), the CPU 11 makes the rotation speed of the pump 752B slower than the rotation speed of the pump 752A and makes the circulation speed of the ink 68 in the head circulation slower than the circulation speed of the ink 68 in the circulation such as bypass circulation other than the head circulation. In this case, as compared to a case where the circulation speed of the ink 68 in the head circulation and the circulation speed of the ink 68 in the circulation such as the bypass circulation other than the head circulation are the same, the load that is applied to the pumps 752A and 752B is reduced due to the slower circulation speed of the ink 68 in the head circulation, and therefore, the suction capability is not lowered. Therefore, the positive pressure that is applied to the ink 68 in the nozzles 111 is reduced, and therefore, the positive pressure that is generated in the cap 91 during the head circulation can be reduced.

Further, the CPU 11 intermittently drives the pump 752A configured to perform the head circulation, in the first circulation processing (S42), and intermittently drives the pump 752B configured to perform the head circulation, in the second circulation processing (S43). By intermittently driving the pump for head circulation, the pressure is not continuously applied to the ink 68 in the nozzles 111, and the positive pressure that is generated in the cap 91 during the head circulation can be reduced.

In addition, in the first circulation processing (S42) or the second circulation processing (S43), the CPU 11 drives the pump 752A and drives the pump 752B to perform the head circulation and the circulation such as the bypass circulation other than the head circulation. Further, the CPU 11 ends the head circulation earlier than the circulation such as the bypass circulation other than the head circulation. In this case, by ending the head circulation earlier than the circulation other than the head circulation, the head circulation can be ended in a state where a negative pressure is generated in the cap 91, and a period for which the positive pressure that is generated in the cap 91 is generated can be shortened.

Further, in the first circulation processing (S42), the CPU 11 drives the pump 752A configured to perform the head circulation, later than the pump 752B configured to perform the circulation such as the bypass circulation other than the head circulation, thereby causing the head circulation to start later than the circulation other than head circulation. Further, in the second circulation processing (S43), the CPU 11 drives the pump 752B configured to perform the head circulation, later than the pump 752A configured to perform the circulation such as the bypass circulation other than the head circulation, thereby causing the head circulation to start later than the circulation other than head circulation. In this case, by causing the head circulation to start later than the circulation other than the head circulation, the negative pressure can be first generated in the cap 91 by the circulation other than the head circulation, and the period for which the positive pressure is generated in the cap 91 at the time of startup of the head circulation can be shortened.

Note that, in the above embodiment, the bypass circulation has been described as an example of the circulation other than the head circulation. However, the circulation other than the head circulation may also be the filter circulation described above. For example, the filter circulation may also be performed instead of the bypass circulation of the first circulation processing and the second circulation processing shown in S42 and S43. In the filter circulation, the ink 68 passes through the filters 75A and 75B or the filters 75C and 75D, so that a flow rate of the ink 68 becomes slow. Therefore, the load that is applied to the pumps 752A and 752B is reduced, and therefore, the suction capability is not reduced, and the possibility that the positive pressure will be generated in the nozzles 111 can be reduced. In addition, the filter circulation can remove deposits of the filters 75A to 75D. On the other hand, since the bypass circulation is closer to the nozzles 111 of the head part 110 than the filter circulation, the negative pressure that is applied to the nozzles 111 is greater, as compared to the filter circulation. Therefore, in the first circulation processing and the second circulation processing, the positive pressure that is generated in the cap 91 can be reduced by setting the bypass circulation as the circulation that is executed at the same time as the head circulation. Further, the circulation other than the head circulation may also be processing in which nothing is circulated. For example, the circulation of the ink 68 may not be performed instead of the bypass circulation in the first circulation processing and the second circulation processing shown in FIG. 12. In this case, since the circulation of the ink 68 is not performed, the positive pressure associated with the circulation of the ink 68 is not generated. Therefore, the positive pressure that is generated in the cap 91 can be reduced. Further, in the liquid-contact circulation, the liquid that is filled in the cap 91 is not limited to the cleaning liquid 76A, and may also be the ink 68 ejected from the nozzles 111 of the head part 110.

In addition, the 'first predetermined time' in S2 and the 'second predetermined time' in S7 are not limited to 6 hours. The predetermined times may be determined as appropriate by a test and the like. In addition, the other predetermined times may also be determined as appropriate, based on a test and the like. Further, the circulation processing shown in FIG. 9 may also be executed not immediately after the end-job maintenance (S3) but after a predetermined time has elapsed. Further, the CPU 11 may perform the end-job maintenance (S3) at a predetermined time. For example, the CPU 11 may perform the end-job maintenance at 8:00 p.m. In the ink supply unit 700A, the bypass flow path may be provided other than the first bypass flow path 801A and the second bypass flow path 802. For example, a third bypass flow path configured to connect the fourth flow path 714C and the fifth bypass flow path 715C may be provided between the first bypass flow path 801A and the second bypass flow path 802. The bypass circulation may be performed via the first bypass flow path 801A, the fourth flow path 714C, the fifth flow path 715C and the third bypass flow path. The same applies to the ink supply unit 700B. Further, in the circulation operation A, the number of times that the first circulation processing (S42) and the second circulation processing (S43) are performed is not limited to three times. In addition, the number of times of the filter circulation processing is not limited to three sets. An appropriate number of times may be set by a test.

The head circulation is not limited to the circulation of the ink 68 between the manifold 170A of the first nozzle row W1 and the manifold 180A of the second nozzle row W2 and between the manifold 170B of the third nozzle row W3 and the manifold 180B of the fourth nozzle row W4. For example, although the plurality of manifolds 171 to 174 is provided to the flow path 62A, one manifold may also be provided. The supply ports may be provided at the front and rear ends of one or more manifolds. For example, the flow path 62A shown in FIG. 4 may be connected to the supply port at the front end of one manifold, and the flow path 62B shown in FIG. 4 may be connected to the supply port at the rear end of the one manifold. Similarly, the flow path 62C shown in FIG. 4 may be connected to the supply port at the front end of another manifold, and the flow path 62D shown in FIG. 4 may be connected to the supply port at the rear end of the another manifold. In this case, the cap may surround only the nozzles corresponding to the two manifolds. Therefore, in one of the first circulation processing and the second circulation processing shown in S42 and S43, the CPU 11 may execute the circulation processing in the manifold connected to the flow paths 62A and 62B, and in the other of the first circulation processing and the second circulation processing, the CPU 11 may execute the circulation processing in the manifold connected to the flow paths 62C and 62D. Therefore, in the above embodiment, there are four nozzle rows, but in this modified embodiment, it is sufficient to provide at least two nozzle rows. Therefore, in the present disclosure, a plurality of nozzle rows may be provided.

During the bypass circulation of the first circulation processing and the second circulation processing shown in S42 and S43, the CPU 11 closes the electromagnetic valve 763A and the electromagnetic valve 763B, but may open the same. When a temperature is low, a viscosity of the ink 68 increases. As a result, the resistance of the flow path through which the ink 68 flows increases. Therefore, the load of the pumps 752A and 752B increases. Thus, when the electromagnetic valves 763A, 766A, 763B and 766B are closed and the bypass circulation is executed, the positive pressure may be generated without the negative pressure by the bypass circulation. Therefore, the CPU 11 can reduce a value of the positive pressure by opening the electromagnetic valve 763A and the electromagnetic valve 763B. That is, in the first circulation processing and the second circulation processing shown in S42 and S43, the CPU 11 determines whether the temperature is equal to or lower than a predetermined temperature, based on an output from a thermometer (not shown). When the temperature is equal to or lower than the predetermined temperature, the CPU 11 closes the electromagnetic valve 763A and the electromagnetic valve 763B. When the temperature is higher than the predetermined temperature, the CPU 11 opens the electromagnetic valve 763A and the electromagnetic valve 763B. Thereby, the positive pressure that is generated in the cap 91 can be reduced.

What is claimed is:

1. An inkjet printer comprising:

a nozzle surface provided on a head and having a plurality of nozzle rows each having a plurality of nozzles;

a plurality of manifolds configured to supply ink to the nozzles provided in each nozzle row;

supply flow paths connected to at least one of the manifolds and configured to supply the ink to the manifold connected to the supply flow paths;

circulation flow paths connected to at least one of the manifolds and configured to circulate the ink from the manifold to which the ink is supplied through the supply flow path;

a cap provided to be in contact with the nozzle surface on an outside of the nozzles respectively provided in at least two of the nozzle rows; and a controller configured to execute first circulation processing where head circulation of circulating the ink through one of the supply flow paths, one of the manifolds and one of the circulation flow paths is performed, and head circulation of circulating the ink through another of the supply flow paths, another of the manifolds and another of the circulation flow paths is not performed, in a liquid-contact state where the ink or a cleaning liquid supplied in the cap is contacted with the nozzle surface.

2. The inkjet printer according to claim 1, wherein the controller is configured to execute second circulation processing where the head circulation of circulating the ink through the another of the supply flow paths, the another of the manifolds and the another of the circulation flow paths is performed, and the head circulation of circulating the ink through the one of the supply flow paths, the one of the manifolds and the one of the circulation flow paths is not performed, in the liquid-contact state.

3. The inkjet printer according to claim 2, further comprising one bypass flow path configured to connect the one of the supply flow paths and the one of the circulation flow paths, wherein the controller is configured to execute the second circulation processing where bypass circulation of circulating the ink through the one of the supply flow paths, the one bypass flow path and the one of the circulation flow paths is performed.

4. The inkjet printer according to claim 2, wherein the controller is configured to cause a circulation speed of the ink in the head circulation and a circulation speed of the ink in circulation other than the head circulation to differ from each other, in the first circulation processing or the second circulation processing.

5. The inkjet printer according to claim 4, wherein the controller is configured to cause the circulation speed of the ink in the head circulation to be slower than the circulation speed of the ink in the circulation other than the head circulation, in the first circulation processing or the second circulation processing.

6. The inkjet printer according to claim 2, further comprising a pump configured to circulate the ink, wherein the controller is configured to intermittently drive the pump for the head circulation, in the first circulation processing or the second circulation processing.

7. The inkjet printer according to claim 2, wherein the controller is configured to perform the head circulation and circulation other than the head circulation to end the head circulation earlier than the circulation other than the head circulation, in the first circulation processing or the second circulation processing.

8. The inkjet printer according to claim 2, wherein the controller is configured to start the head circulation later than circulation other than the head circulation, in the first circulation processing or the second circulation processing.

9. The inkjet printer according to claim 1, further comprising another bypass flow path configured to connect the another of the supply flow paths and the another of the circulation flow paths, wherein the controller is configured to execute the first circulation processing where bypass circulation of circulating the ink through the another of the supply flow paths, the another bypass flow path and the another of the circulation flow paths is performed.

10. The inkjet printer according to claim 1, wherein the nozzle rows include a first nozzle row, a second nozzle row, a third nozzle row and a fourth nozzle row, the manifolds include:

a first manifold configured to supply the ink to the nozzles provided in the first nozzle row;

a second manifold configured to communicate with the first manifold and to supply the ink to the nozzles provided in the second nozzle row;

a third manifold configured to supply the ink to the nozzles provided in the third nozzle row; and a fourth manifold configured to communicate with the third manifold and to supply the ink to the nozzles provided in the fourth nozzle row, the supply flow paths include:

a first supply flow path connected to one of the first manifold and the second manifold, and configured to supply the ink to the manifold connected to the first supply flow path; and a second supply flow path connected to one of the third manifold and the fourth manifold, and configured to supply the ink to the manifold connected to the second supply flow path, the circulation flow paths include:

a first circulation flow path connected to the other of the first manifold and the second manifold, and configured to circulate the ink; and a second circulation flow path connected to the other of the third manifold and the fourth manifold, and configured to circulate the ink, the cap is provided to be in contact with the nozzle surface on an outside of the nozzles respectively provided in the first nozzle row, the second nozzle row, the third nozzle row and the fourth nozzle row, and the controller is configured to execute the first circulation processing where head circulation of circulating the ink through the first supply flow path, the first manifold, the second manifold and the first circulation flow path is performed, and head circulation of circulating the ink through the second supply flow path, the third manifold, the fourth manifold and the second circulation flow path is not performed, in the liquid-contact state.

11. The inkjet printer according to claim 10, wherein the controller is configured to execute second circulation processing where the head circulation of circulating the ink through the second supply flow path, the third manifold, the fourth manifold and the second circulation flow path is performed, and the head circulation of circulating the ink through the first supply flow path, the first manifold, the second manifold and the first circulation flow path is not performed, in the liquid-contact state.

12. The inkjet printer according to claim 11, further comprising a first bypass flow path configured to connect the first supply flow path and the first circulation flow path, wherein the controller is configured to execute the second circulation processing where bypass circulation of circulating the ink through the first supply flow path, the first bypass flow path and the first circulation flow path is performed.

13. The inkjet printer according to claim 10, further comprising a second bypass flow path configured to connect the second supply flow path and the second circulation flow path, wherein the controller is configured to execute the first circulation processing where bypass circulation of circulating the ink through the second supply flow path, the second bypass flow path and the second circulation flow path is performed.

14. A non-transitory computer-readable medium storing computer-readable instructions, when executed by a computer of an inkjet printer comprising:

a nozzle surface provided on a head configured to eject ink and having a plurality of nozzle rows each having a plurality of nozzles configured to eject the ink;

a plurality of manifolds configured to supply the ink to the nozzles provided in each nozzle row;

supply flow paths connected to at least one of the manifolds and configured to supply the ink to the manifold connected to the supply flow paths;

circulation flow paths connected to at least one of the manifolds and configured to circulate the ink from the manifold to which the ink is supplied through the supply flow path;

a cap provided to be in contact with the nozzle surface on an outside of the nozzles respectively provided in at least two of the nozzle rows; and the computer, wherein the computer-readable instructions cause the computer to perform:

first circulation processing where head circulation of circulating the ink through one of the supply flow paths, one of the manifolds and one of the circulation flow paths is performed, and head circulation of circulating the ink through another of the supply flow paths, another of the manifolds and another of the circulation flow paths is not performed, in a liquid-contact state where the ink or a cleaning liquid supplied in the cap is contacted with the nozzle surface.

* * * * *